US008997270B2

(12) United States Patent
Murata et al.

(10) Patent No.: US 8,997,270 B2
(45) Date of Patent: Apr. 7, 2015

(54) AUTOMATIC FAUCET

(75) Inventors: Kensuke Murata, Kitakyushu (JP); Hiroshi Tsuboi, Kitakyushu (JP); Shoichi Tsuiki, Kitakyushu (JP); Yuya Masahira, Kuki (JP)

(73) Assignee: Toto Ltd. (JP)

( * ) Notice: Subject to any disclaimer, the term of this patent is extended or adjusted under 35 U.S.C. 154(b) by 221 days.

(21) Appl. No.: 13/820,946

(22) PCT Filed: Sep. 8, 2011

(86) PCT No.: PCT/JP2011/070500

§ 371 (c)(1),
(2), (4) Date: Mar. 5, 2013

(87) PCT Pub. No.: WO2012/033166

PCT Pub. Date: Mar. 15, 2012

(65) Prior Publication Data

US 2013/0160202 A1 Jun. 27, 2013

(30) Foreign Application Priority Data

| | | |
|---|---|---|
| Sep. 8, 2010 | (JP) | 2010-200615 |
| Sep. 8, 2010 | (JP) | 2010-200616 |
| Mar. 28, 2011 | (JP) | 2011-069390 |
| Mar. 28, 2011 | (JP) | 2011-069391 |

(51) Int. Cl.
*E03C 1/05* (2006.01)

(52) U.S. Cl.
CPC ..... *E03C 1/057* (2013.01)

(58) Field of Classification Search
CPC ..... E03C 1/057; E03C 1/05
USPC ..... 4/623
See application file for complete search history.

(56) References Cited

U.S. PATENT DOCUMENTS

| | | | | |
|---|---|---|---|---|
| 5,984,262 | A | 11/1999 | Parsons et al. | |
| 6,340,032 | B1 * | 1/2002 | Zosimadis | 137/552 |
| 7,731,154 | B2 * | 6/2010 | Parsons et al. | 251/129.04 |
| 2003/0213062 | A1 * | 11/2003 | Honda et al. | 4/623 |
| 2011/0000559 | A1 | 1/2011 | Murata et al. | |

FOREIGN PATENT DOCUMENTS

| | | | |
|---|---|---|---|
| JP | 4-360923 | A | 12/1992 |
| JP | 2002070096 | A | 3/2002 |
| JP | 2006-219891 | A | 8/2006 |

(Continued)

OTHER PUBLICATIONS

Office Action for JP2011-069390, Dated May 19, 2011, English translation attached or original, All together 5 Pages.

*Primary Examiner* — Huyen Le
(74) *Attorney, Agent, or Firm* — Brooks Kushman P.C.

(57) ABSTRACT

Provided is an automatic faucet using a radio wave sensor, which is capable of preventing erroneous stop of water spouting, with a simple configuration. The automatic faucet (1) has a radio wave propagation space, a radio wave emitting port (27), and directivity setting device. The directivity setting device is configured to direct a radio wave being emitted from the radio wave emitting port (27), in such a manner that, during a water stopping state, the emitted radio wave lies along a spouting direction (A) along which washing water is to be spouted from a spout port (26), and, during a water spouting state, a part of the radio wave emitted disposed offset in a direction C, with respect to the spout port (26) interferes with a region of a peripheral surface of a stream (W) facing in the direction C.

5 Claims, 16 Drawing Sheets

(56) References Cited

FOREIGN PATENT DOCUMENTS

| | | | |
|---|---|---|---|
| JP | 2006-283441 | A | 10/2006 |
| JP | 2010-144497 | A | 7/2010 |
| WO | 2009/081544 | A1 | 7/2009 |

* cited by examiner

AUTOMATIC FAUCET

CROSS-REFERENCE TO RELATED APPLICATION

This application is the U.S. national phase of PCT Appln. No. PCT/JP2011/070500 filed on Sep. 8, 2011, which claims priority to JP Patent Application No. 2010-200615 filed on Sep. 8, 2010, JP Patent Application No. 2010-200616 filed on Sep. 8, 2010, JP Patent Application No. 2011-069390 filed on Mar. 28, 2011, and JP Patent Application No. 2011-069391 filed on Mar. 28, 2011, the disclosures of which are incorporated in their entirety by reference herein.

TECHNICAL FIELD

The present invention relates to an automatic faucet, and more particularly to an automatic faucet for automatically starting and stopping spouting water by using a radio wave sensor.

BACKGROUND ART

Heretofore, there has been known an automatic faucet for automatically starting and stopping spouting water by using a radio wave sensor (see, for example, the following Patent Document 1). Such an automatic faucet comprises a photoelectric sensor installed inside a distal end of a conduit pipe. When a user inserts his/her hand within a sensing range of the photoelectric sensor, the photoelectric sensor senses the presence of the hand, and, in response to the sensing, spouting of water from a spout port is automatically started. Then, when the user pulls out the hand from the sensing range, the photoelectric sensor ceases to sense the presence of the hand, and thereby the spouting of water from the spout port is automatically stopped.

Meanwhile, in the automatic faucet, during use, a user can move his/her hand toward the spout port from various directions. On the other hand, the photoelectric sensor has strong or narrow directivity. Thus, in order to reliably sense the user's hand being inserted from various directions by using the photoelectric sensor, it is necessary to install the sensing range of the photoelectric sensor at a position adjacent to the spout port where the user's hand is certainly placed. This means that the user's hand can be sensed by the photoelectric sensor only after it reaches the spout port. Thus, the automatic faucet using the photoelectric sensor has difficulty in obtaining enhanced response.

There has also been known an automatic faucet using a radio wave sensor (microwave sensor) having a broad sensing range, instead of the photoelectric sensor (see, for example, the Patent Document 2). In an automatic faucet described in the Patent Document 2, a radio wave sensor is installed on the side of a sink, and a direction of a radio wave beam to be emitted from the radio wave sensor is set to be oriented upwardly.

As compared to the photoelectric sensor, the radio wave sensor has wider directivity and a broader sensing range. Thus, the automatic faucet using the radio wave sensor is capable of, even if a user moves his/her hand toward a spout port from various directions, sensing the user's hand before it reaches the spout port, thereby obtaining enhanced response.

In the automatic faucet using the photoelectric sensor, in addition to the above problem that it is not easy to obtain enhanced response during start of water spouting, the necessity to install the photoelectric sensor at a position adjacent to the spout port due to its characteristics gives rise to another problem of deterioration in design flexibility. That is, the photoelectric sensor and associated components such as wirings and electric components have to be installed within the conduit pipe at positions adjacent to the spout port, which imposes restrictions on design flexibility.

On the other hand, the automatic faucet having the radio wave sensor installed on the sink side can enhance design flexibility. However, it is not easy to achieve adequate response. That is, due to the layout where the radio wave sensor is installed on the sink side, if it is attempted to increase a radio field intensity in a vicinity of the spout port, the radio field intensity will be increased not only in the vicinity of the spout port but also all around the faucet, resulting in an excessively broad sensing range. Thus, the automatic faucet having the radio wave sensor installed on the sink side has a problem that erroneous water spouting is more likely to occur in response to a water removing motion just after completion of hand washing, and a hand-lathering motion during hand washing.

Therefore, the applicant (inventors) of this application proposed an automatic faucet in which a water pipe and waveguide are provided side-by-side within a conduit pipe, and a radio wave is guided from a radio wave sensor to a spout region via the waveguide (see the Patent Document 3). This automatic faucet can set a sensing range around a spout port. Thus, it is considered that response during start and stop of water spouting can be enhanced.

LIST OF PRIOR ART DOCUMENTS

Patent Documents

Patent Document 1: JP 04-360923A
Patent Document 2: JP 2006-219891A
Patent Document 3: JP 2010-144497A

SUMMARY OF THE INVENTION

Technical Problem

However, the automatic faucet described in the Patent Document 3 is configured such that a portion of the water pipe around the spout port is disposed above the waveguide, so that, during a water spouting state, washing water is spouted from the spout port to pass through a position on a user side with respect to a radio wave emitting port of the waveguide, and thereby an emitted radio wave is blocked by the washing water. Thus, during the water spouting state, a sensing range of the radio wave sensor is significantly narrowed in terms of a region on a user side with respect to a stream of the washing water, as compared to a sensing range during a water stopping state.

As above, in the automatic faucet described in the Patent Document 3, the user-side region of the sensing range is narrowed during the water spouting state, which is advantageous in that water spouting can be stopped immediately after a user pulls out his/her hand from the stream after completion of hand washing. However, the applicant has found that the automatic faucet described in the Patent Document 3 has the following problem. In the automatic faucet described in the Patent Document 3, the user-side region of the sensing range is excessively narrowed during the water spouting state, so that even in a situation where, during hand washing, a user slightly displaces his/her hand in the stream, toward the user side, to perform a hand-lathering motion, the sensing of the hand is interrupted. That is, the applicant has found that, in the automatic faucet described in the Patent Document 3, water spouting is likely to be erroneously stopped during the hand-lathering motion, despite it is normally desired to continue the water spouting there during.

The present invention has been made to solve this problem, and an object thereof is to provide an automatic faucet using a radio wave sensor, which is capable of preventing erroneous stop of water spouting, with a simple configuration.

Solution to the Technical Problem

In order to solve the above problem, the present invention provides an automatic faucet which comprises: a faucet main unit including a conduit pipe having a base end fixed to a support body and extending toward a user side, and a spout valve; a water pipe disposed inside the conduit pipe and adapted to supply washing water to a spout port formed in a spout region as a distal end portion of the faucet main unit; a radio wave sensor operable to output a detection signal for sensing a user's behavior state; and control means operable, based on the detection signal from the radio wave sensor, to switch between open and closed states of the spout valve to thereby start and stop spouting of the washing water from the spout port. The automatic faucet is characterized in that it further comprises: a radio wave propagation space defined between an inner peripheral surface of the conduit pipe and an outer peripheral surface of the water pipe so as to allow a radio wave to be propagated therethrough, wherein the radio wave sensor is provided in the faucet main unit at a position on the side of the base end, and set to emit a radio wave into the radio wave propagation space; a radio wave emitting port formed in the spout region to communicate with the radio wave propagation space so as to emit a radio wave propagated through the conduit pipe, to the outside therethrough; and directivity setting means for setting directivity of a radio wave to be emitted from the radio wave emitting port. The directivity setting means is configured to direct a radio wave being emitted from the radio wave emitting port, in such a manner that, during a water stopping state, the emitted radio wave lies along a spouting direction along which washing water is to be spouted from the spout port, and, during a water spouting state, a part of the radio wave emitted from a region of the radio wave emitting port disposed offset toward the user side with respect to the spout port at least partially interferes with a user-side region of a peripheral surface of a stream of the spouted washing water.

In the above automatic faucet of the present invention, the directivity setting means is configured to direct a radio wave being emitted from the radio wave emitting port formed in the spout region, in a direction along the spouting direction of washing water, so that, during the water stopping state, a sensing range of the radio wave sensor can be formed along the spouting direction. Thus, in the present invention, during the water stopping state, even if a user inserts his/her hand toward the spout port from any direction, the sensing range extending from a vicinity of the spout port in the spouting direction allows the hand to be sensed just before it reaches a washing point. This makes it possible to start water spouting at an adequate timing.

On the other hand, in the present invention, the directivity setting means is also configured to, during the water stopping state, allow a part of the radio wave emitted from a region of the radio wave emitting port disposed offset toward the user side with respect to the spout port, to interfere with a user-side region of the peripheral surface of the stream of washing water spouted from the spout port. Thus, in the present invention, during the water spouting state, the sensing range can be formed in a region on the user side with respect to the stream, so that, even in the situation where, during hand washing, a user slightly displaces his/her hand in the stream, toward the user side, to perform a hand-lathering motion or the like, the sensing of the hand can be continued. This makes it possible to prevent unwanted interruption of the water spouting.

Preferably, in the automatic faucet of the present invention, a portion of the water pipe located in the spout region is configured to spout washing water in an obliquely forward and downward direction.

According to this feature, the spouting direction of washing water is set to an obliquely forward and downward direction, so that, during the water spouting state, the sensing range is formed on an upper side of (on the user side with respect to) the stream. Thus, even if a user performs a hand-lathering motion on the upper side of the stream, the water spouting can be continued without interruption thereof.

More preferably, in the above automatic faucet, the radio wave emitting port is configured to surround upper and lateral regions of the outer peripheral surface of the water pipe, so as to cause a radio wave emitted from the radio wave emitting port, to at least partially interfere with upper and lateral regions of the peripheral surface of the stream.

According to this feature, the radio wave is brought into interference with opposite lateral regions of the peripheral surface of the stream as well as the upper region of the peripheral surface of the stream, so that the sensing range can be additionally formed in a lateral direction of the stream. Thus, even if, during hand washing, a user slightly displaces his/her hand in the lateral direction of the stream to perform a hand-lathering motion or the like, the water spouting can be continued. This makes it possible to prevent unwanted interruption of the water spouting.

More preferably, in the above automatic faucet, the radio wave emitting port is configured to define a substantially elongate window extending in a direction orthogonal to the spouting direction, so as to cause the radio wave to interfere with an upper region of the peripheral surface of the stream, in a state in which an electric field component of the radio wave crosses orthogonally to upper region of the peripheral surface of the stream.

According to this feature, the radio wave emitting port can be formed as the substantially elongate window extending in a direction orthogonal to the spouting direction, to allow the radio wave to interfere with the stream in the state in which an electric field component thereof crosses orthogonally to the stream. In this way, an electric field component of the radio wave is set to cross orthogonally to the stream, which makes it possible to enhance an interference action between the radio wave and the stream (i.e., radio wave attenuating action and reflecting action). This facilitates forming a sensing range suited to the water spouting state.

More preferably, in the above automatic faucet, the directivity setting means is configured to direct a radio wave being emitted from the radio wave emitting port, in such a manner that, during the water spouting state, the radio wave is attenuated by interference with the stream, more largely on the base end side than on the user side with respect to the stream.

According to this feature, during the water spouting state, the radio wave is attenuated more largely on the base end side (the side opposite to the user side) than on the user side with respect to the stream, so that washing water rebounding from a sink toward a lower region of the peripheral surface of the washing water stream directed in the obliquely forward and downward direction becomes less likely to be sensed. This makes it possible to satisfy, during the water spouting state, both a need for preventing the water spouting from being undesirably interrupted due to a hand-lathering motion, and a need for preventing the water spouting from being needlessly continued due to rebound of washing water from a sink.

More preferably, in the above automatic faucet, the directivity setting means is configured to direct a radio wave being emitted from the radio wave emitting port, in such a manner that washing water spouted from the spout port passes through a region offset toward the base end side with respect to the stream, in a sensing range of the radio wave sensor during the water stopping state.

According to this feature, during the water spouting state, washing water passes through a position offset toward the base end side, in the sensing range during the water stopping state, so that, during the water spouting state, the sensing range during the water stopping state is reduced in terms of a base end-side region due to attenuation of the radio wave caused by the washing water. Thus, during the water spouting state, the sensing range is less likely to include a region below the stream, so that washing water rebounding from a sink becomes far less likely to be sensed. This makes it possible to satisfy, during the water spouting state, both the need for preventing the water spouting from being undesirably interrupted due to a hand-lathering motion, and the need for preventing the water spouting from being needlessly continued due to rebound of washing water from a sink.

More preferably, in the above automatic faucet, the directivity setting means is configured to cause a radio wave emitted from the radio wave emitting port, to be at least partially brought into interference with and reflected by the upper region of the peripheral surface of the stream, in such a manner that a sensing range of the radio wave sensor during the water spouting state includes a space closer to the user side as compared to the sensing range during the water stopping state.

According to this feature, the emitted radio wave can be reflected by the upper region of the peripheral surface of the stream, to allow at least a part of the sensing range during the water spouting state to be displaced toward the user side with respect to the sensing range during the water stopping state. Thus, even if, during hand washing, a user slightly displaces his/her hand toward the user side, the sensing of the hand can be continued. This makes it possible to prevent unwanted interruption of the water spouting, during hand washing.

More preferably, in the above automatic faucet, the directivity setting means is configured to cause a radio wave emitted from the radio wave emitting port, to be at least partially attenuated by the stream, in such a manner that the sensing range during the water spouting state is reduced in terms of a region below the stream, as compared to the sensing range during the water stopping state.

According to this feature, based on the interference between the radio wave and the stream, the sensing range during the water spouting state can be reduced in terms of a region below the stream, as compared to the sensing range during the water stopping state, so that washing water rebounding from a sink becomes far less likely to be sensed. This makes it possible to satisfy, during the water spouting state, both the need for preventing the water spouting from being undesirably interrupted due to a hand-lathering motion, and the need for preventing the water spouting from being needlessly continued due to rebound of washing water from a sink.

More preferably, the above automatic faucet, the directivity setting means is configured to cause a radio wave emitted from the radio wave emitting port, to be reflected by the stream, in such a manner that the sensing range during the water spouting state is expanded in an upward direction and a lateral direction with respect to the stream, as compared to the sensing range during the water stopping state.

According to this feature, during the water spouting state, the emitted radio wave can be reflected by the stream, to allow the sensing range to be expanded in an upward direction and a lateral direction with respect to the stream. Thus, even if, during hand washing, a user slightly displaces his/her hand in the upward direction and the lateral direction with respect to the stream, the water spouting can be continued. This makes it possible to prevent unwanted interruption of the water spouting, during hand washing.

More preferably, in the above automatic faucet, the directivity setting means is configured to cause a radio wave emitted from the radio wave emitting port, to be attenuated and reflected by the stream, in such a manner that the sensing range during the water spouting state is reduced in the spouting direction, as compared to the sensing range during the water stopping state.

According to this feature, during the water spouting state, the sensing range during the water spouting state is reduced in the spouting direction, as compared to the sensing range during the water stopping state. This makes it possible to satisfy, during the water spouting state, both the need for preventing the water spouting from being undesirably interrupted due to a hand-lathering motion, and the need for preventing the water spouting from being needlessly continued due to rebound of washing water from a sink.

More preferably, in the above automatic faucet, the spout port has a cross-sectionally circular shape and is located within the radio wave emitting port, wherein the water pipe in the spout region is in contact with a lower region of an inner peripheral surface of the radio wave emitting port.

According to this feature, when viewed from the spouting direction, the water pipe is disposed in contact relation with the lower region of the inner peripheral surface of the radio wave emitting port, so that a radio wave being emitted from the radio wave emitting port mainly exists on an upper side and right and left lateral sides of the stream, and scarcely exists on a lower side of the stream. Thus, during the water spouting state, the emitted radio wave can be brought into interference with (reflected by) an upper region and right and left lateral regions of the peripheral surface of the stream, to allow the sensing range to be expanded in the upward direction and the lateral direction with respect to the stream. On the other hand, the stream passes through a lower region in the sensing range during the water stopping state, so that the sensing range during the water spouting state is largely attenuated in terms of a region below the stream. This makes it possible to, during the water spouting state, prevent the water spouting from being undesirably interrupted due to a hand-lathering motion, and prevent the water spouting from being needlessly continued due to rebound of washing water from a sink.

Effect of the Invention

In an automatic faucet using a radio wave sensor, the present invention can prevent erroneous start and stop of water spouting, with a simple configuration.

DESCRIPTION OF EMBODIMENTS

With reference to FIGS. 1 to 20, an automatic faucet according to one embodiment of the present invention will now be described.

Figure 1:
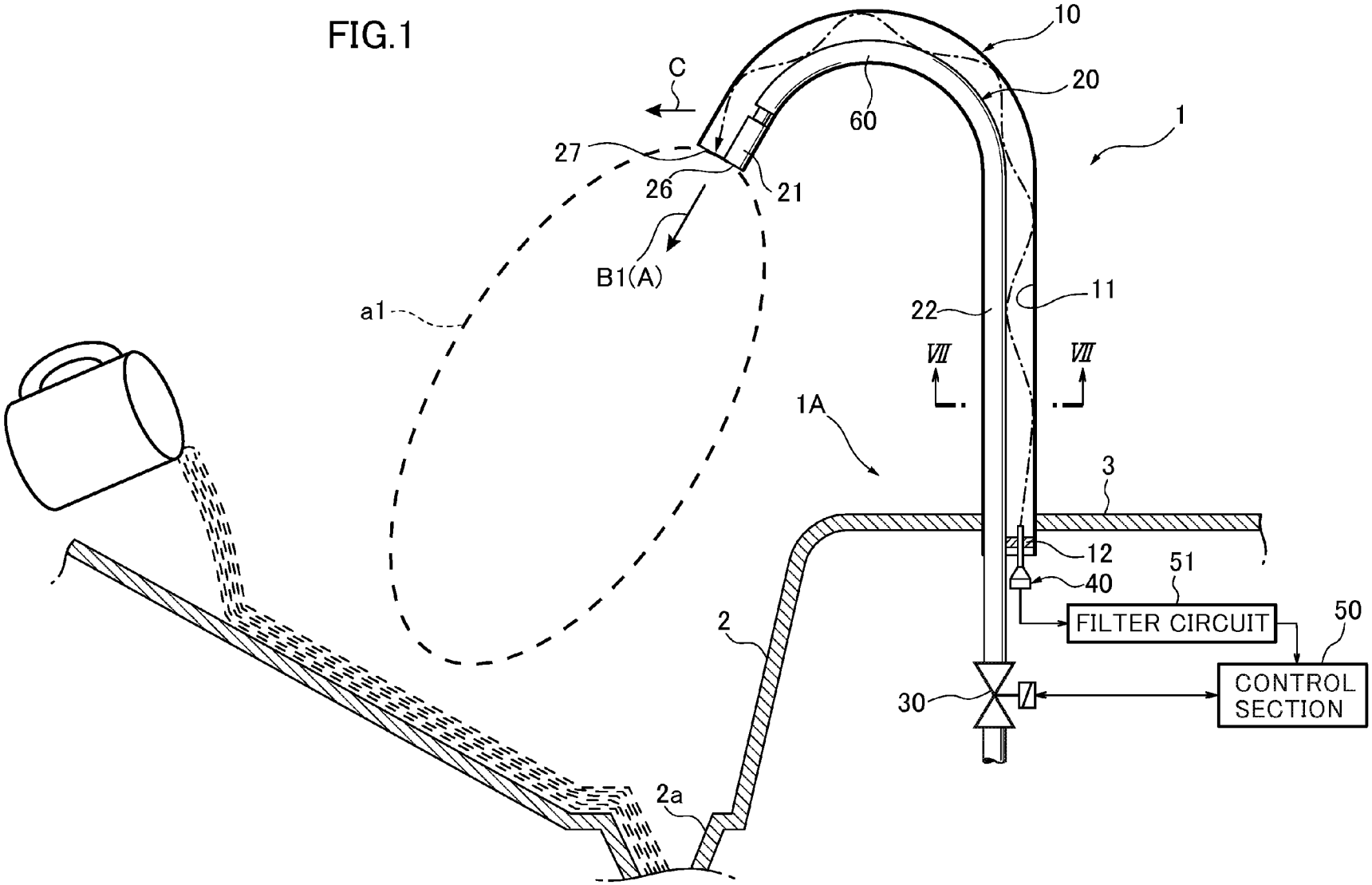
FIG. 1 is a general configuration diagram of an automatic faucet according to one embodiment of the present invention, wherein the automatic faucet is in a water stopping state.

FIG. 1 illustrates a state in which the automatic faucet 1 according to this embodiment is attached to a washstand. The washstand comprises a sink 2 having a given concave shape, and a washstand base 3. The sink 2 has a sink outlet 2*a* provided in a bottom wall thereof.

As illustrated in FIG. 1, the automatic faucet 1 according to this embodiment comprises: a faucet main unit 1A which includes a conduit pipe (faucet spout) 10 having a base end fixed to the washstand base (support body) 3 and extending toward a user side C, and a spout valve 30; a water pipe 20 inserted into the conduit pipe 10; a radio wave sensor 40 for detecting a user's behavior state including the presence or absence of a user or the presence or absence of usage; and a control section 50 for controlling an opening and closing action of the spout valve 30.

The conduit pipe 10 is a hollow tubular member, and made, for example, of a metal material such as steel. In the conduit pipe 10, at least an inner peripheral surface thereof is made of a material capable of reflecting a radio wave. The conduit pipe 10 has a shape which extending vertically from the washstand base 3, and then curves to allow a distal end opening thereof to face a bottom surface of the sink 2. The conduit pipe 10 has an outlet portion oriented in an obliquely forward and downward direction.

The water pipe 20 is coupled to the spout valve 30 and adapted to supply washing water to an aftermentioned spout port 26 formed in a spout region as a distal end portion of the faucet main unit 1A. The water pipe 20 is a tubular member having flexibility as a whole, and comprises a spout cap 21 attached to a distal end thereof, and a flexible pipe 22. The water pipe 20 is adapted to spout washing water from a spout port 26 of the spout cap 21 in a spouting direction A which is the obliquely forward and downward direction, whereby the washing water is supplied toward the bottom surface of the sink 2 which is a water receiving portion.

In this embodiment, the water pipe 20 is configured to spout washing water from the spout port 26 in the obliquely forward and downward direction. Alternatively, it may be configured to spout washing water from the spout port 26 in an approximately vertically downward direction.

The flexible pipe 22 is a tubular member having flexibility. The flexible pipe 22 has an outer peripheral surface at least a part of which is located inside the conduit pipe 10 and made of a material capable of reflecting a radio wave (e.g., a metal material).

The flexible pipe 22 has an upstream end to which the spout valve 30 is directly or indirectly connected, and a downstream end to which the spout cap 21 is connected.

Although this embodiment employs the flexible pipe 22, a tube having flexibility and radio wave permeability may be employed to couple the spout cap 21 and the spout valve 30 together. In this case, it is desirable that a reflecting member made, for example, of a metal material capable of reflecting a radio wave (e.g., aluminum foil) is provided on the entire region of an outer peripheral surface of the tube.

The spout valve 30 is composed of a solenoid valve, and adapted to be selectively opened and closed according to a control signal from the control section 50. The spout valve 30 functions as a constant flow valve adapted, when it is opened, to supply a constant flow rate of washing water toward the spout port 26.

Figure 9:
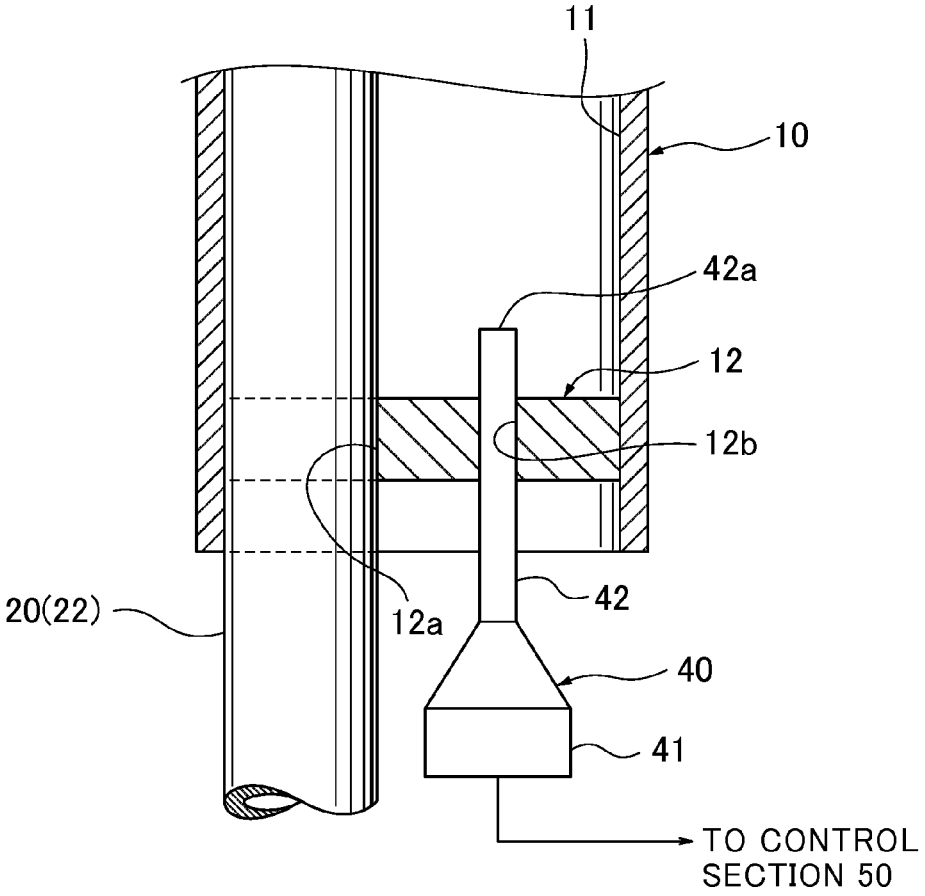
FIG. 9 is a sectional view of an inlet portion of the conduit pipe of the automatic faucet according to this embodiment.

The radio wave sensor 40 is installed inside the faucet main unit 1A, and provided on the side of a base end portion of the faucet main unit 1A. In this embodiment, the radio wave sensor 40 is fixed to the base end of the conduit pipe 10. The radio wave sensor 40 is composed of a microwave Doppler sensor. For example, an operation frequency thereof is about 10 GHz or about 24 GHz. As illustrated in FIG. 9, the radio wave sensor 40 comprises a sensor main unit 41, and a radio wave input-output portion 42 attached to the sensor main unit 41. The sensor main unit 41 is an electronic component comprising a local oscillator, a transmitting antenna, a receiving antenna and a mixer (wave detector). The radio wave input-output portion 42 is a hollow metal component for emitting therethrough a radio wave from the sensor main unit 41 to the outside, and introducing therethrough a reflected wave from the outside into the sensor main unit 41.

The sensor main unit 41 is adapted to: emit a microwave (transmission signal) generated in the local oscillator from the transmission antenna to the outside via the radio wave input-output portion 42; and, after receiving a microwave (reflected wave) reflected by an object (e.g., human hand) by the receiving antenna via the radio wave input-output portion 42, mix the received reflected wave and the transmission signal by the mixer (wave detector) to detect a Doppler signal.

When an object stays still, a transmission wave and a reflected wave have the same frequency, so that the radio wave sensor 40 hardly detects the presence or absence of the object. On the other hand, when an object is moving, the frequency of the reflected wave is changed, so that a differential signal appears on an output of the mixer. The radio wave sensor 40 is operable, based on differential signal, to detect the presence or absence of and a moving direction (approaching or departing) of the object, and output a detection signal (see FIG. 11) to the control section 50. The detection signal is a speed signal having a frequency component depending on a movement speed of an object, and a signal indicative of the presence of a moving object.

Figure 11:
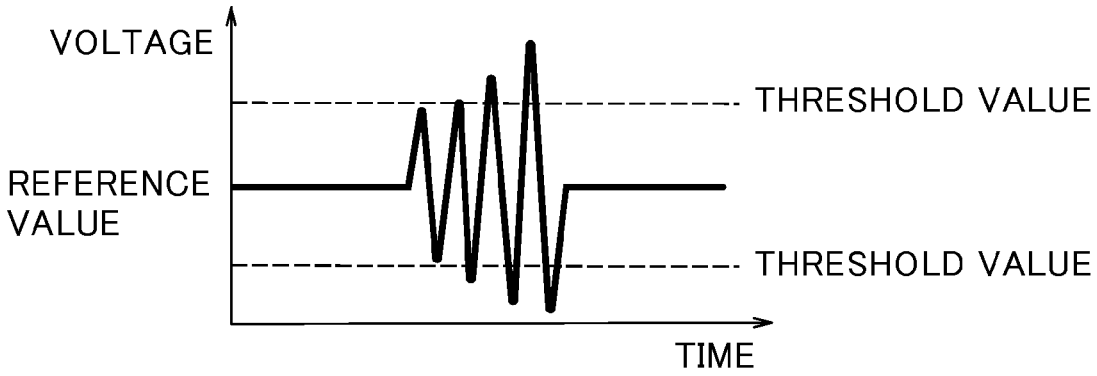
FIG. 11 is a graph illustrating a temporal change of a detection signal in this embodiment.

The control section 50 is constructed using a microcomputer and others, and operable to receive the detection signal from the radio wave sensor 40 via a filter circuit 51. As illustrated in FIG. 11, the control section 50 is programmed to, in response to receiving a detection signal having a signal value which is equal to or greater than a certain voltage threshold value (absolute value) with respect to a reference value (e.g., 0 volt), output a driving signal for setting the spout valve 30 to an open state, and, in response to receiving a detection signal having a signal value which is less than the certain voltage threshold value (absolute value) with respect to the reference value, output a driving signal for setting the spout valve 30 to a closed state. That is, the control section 50 is operable, based on a signal value of a detection signal in comparison with a voltage threshold, to determine a sensing range of the radio wave sensor 40. Thus, when an object is detected, the spout valve 30 is maintained in the open state to establish a water spouting state. On the other hand, when no object is detected, the spout valve 30 is maintained in the closed state to establish a water stopping state.

The filter circuit 51 comprises a bandpass filter for permitting only a detection signal in a predetermined frequency range to pass therethrough. The filter circuit 51 allows only a detection signal in a frequency range corresponding to movement (motion) of a human hand to be sent to the control section 50, which makes it possible to suppress false detection.

Figure 12:
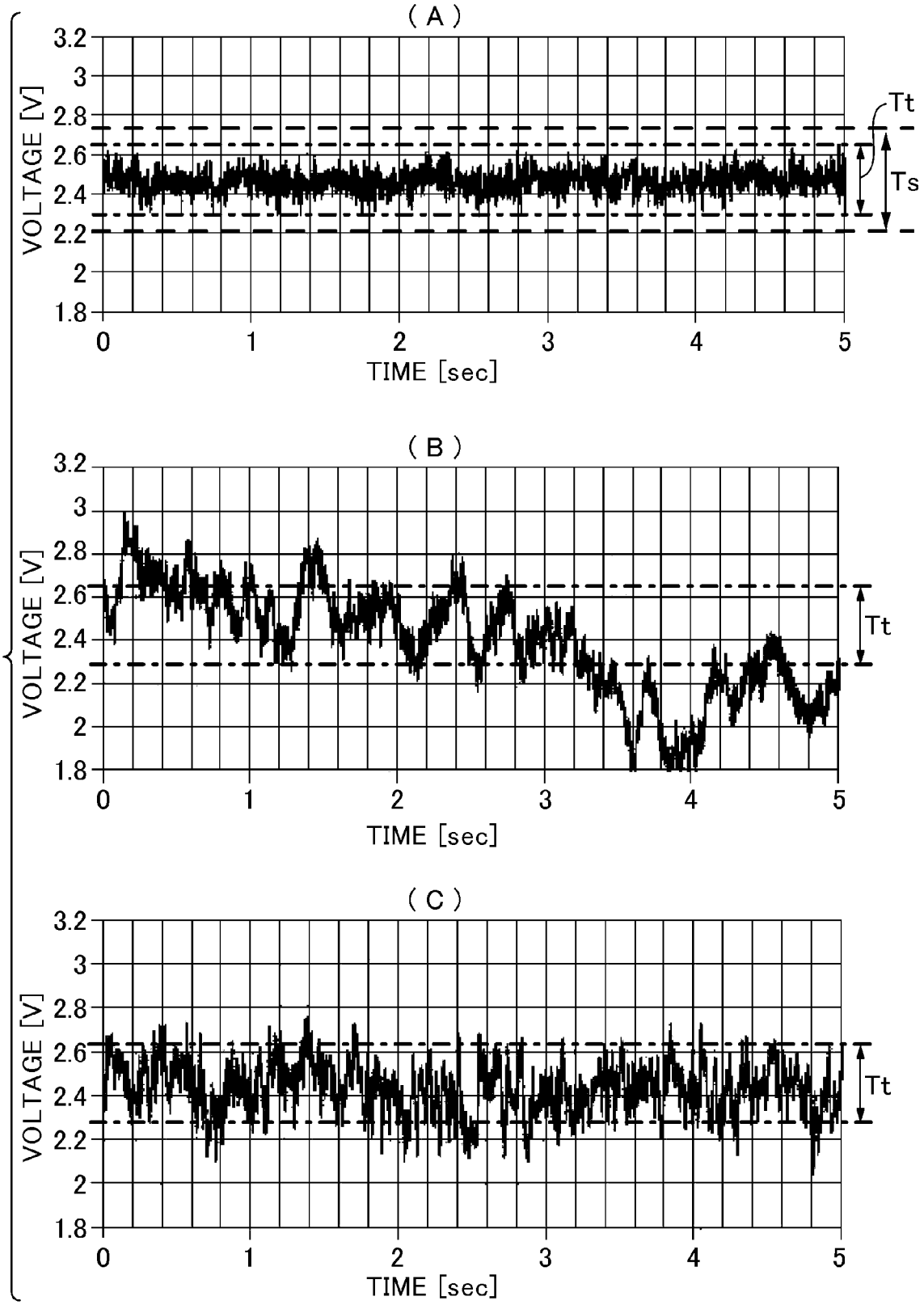
FIG. 12 is a graph illustrating a specific example of the temporal change of the detection signal in this embodiment.

FIG. 12 illustrates a specific example of the detection signal.

FIG. 12(A), FIG. 12(B) and FIG. 12(C) correspond, respectively, to a situation where washing water is spouted from the spout port 26 (washing water reaches the bottom surface of the sink 2 without any obstruction), a situation where water is being received in a resin cup, and a situation where a user is washing both hands in a washing water stream. In FIG. 12, the reference value is about 2.5 V.

In this embodiment, the control section 50 has two thresholds. Specifically, they consist of a water-spouting start threshold Ts for determining start of water spouting, and a water-spouting stop threshold Tt for determining stop of water spouting. In FIG. 12, each of the threshold values is represented as a range having a center defined by the reference value.

The control section 50 is operable, when an amplitude of the detection signal during the water stopping state becomes equal to or greater than the water-spouting start threshold Ts, to perform control of starting water spouting, and, when the amplitude of the detection signal during the water spouting state becomes less than the water-spouting stop threshold Tt, to perform control of stopping the water spouting.

As illustrated in FIG. 12(A), the water-spouting stop threshold Tt is set to a value greater than an amplitude of a small detection signal to be sensed in the situation where washing water reaches the bottom surface of the sink 2 without any obstruction. Further, the water-spouting stop threshold Tt is set to a value less than an amplitude of a large detection signal to be sensed in the situation where a user washes his/her hand in washing water. Thus, an amplitude of a detection signal after completion of the hand washing becomes less than the water-spouting stop threshold Tt, so that the control section 50 can operate to stop the water spouting immediately after completion of the hand washing.

On the other hand, as illustrated in FIGS. 12 (B) and 12(C), during receiving of water in a cup and during hand washing, a detection signal having an amplitude greater than the water-spouting stop threshold Tt, so that the control section 50 can operate to continue the water spouting. This makes it possible to prevent the water spouting from being stopped during receiving of water in a cup and during hand washing.

An outline of the sensing range of the radio wave sensor 40 in the automatic faucet 1 according to this embodiment will be described below. The automatic faucet 1 is configured such that the sensing range of the radio wave sensor 40 is changed depending on the presence or absence of spouting of washing water from the spout port 26.

FIGS. 1 and 3(A) illustrate a sensing range a1 during the water stopping state. The sensing range a1 is formed to elongatedly extend from a vicinity of the spout port 26, along an emitting direction B1 (spouting direction A). Further, in order to prevent water poured into the sink 2 from being sensed, the sensing range a1 is set to keep a lower edge thereof from reaching the bottom surface of the sink 2.

Figure 2:
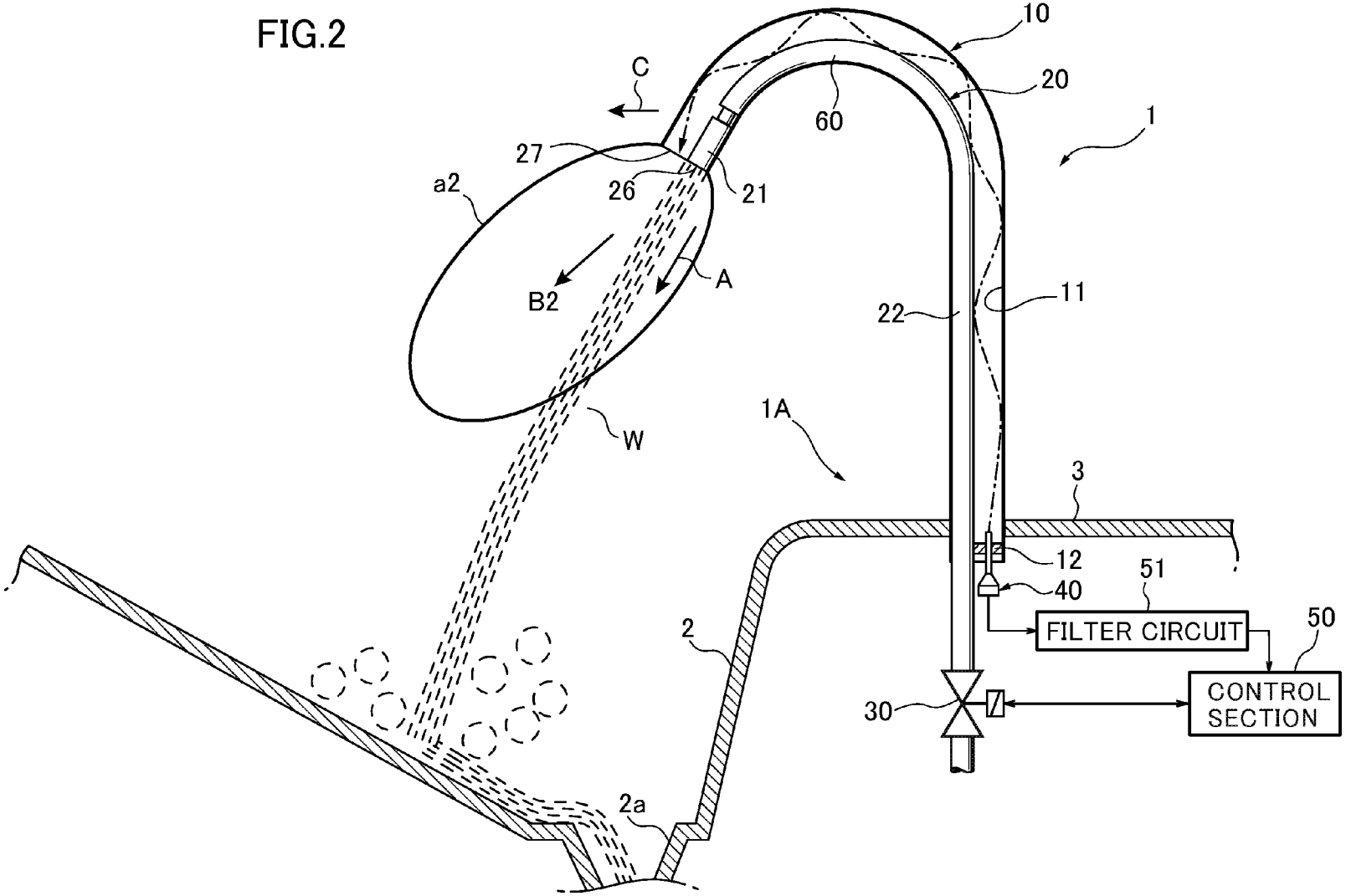
FIG. 2 is a general configuration diagram of the automatic faucet according to this embodiment, wherein the automatic faucet is in a water spouting state.
Figure 3:
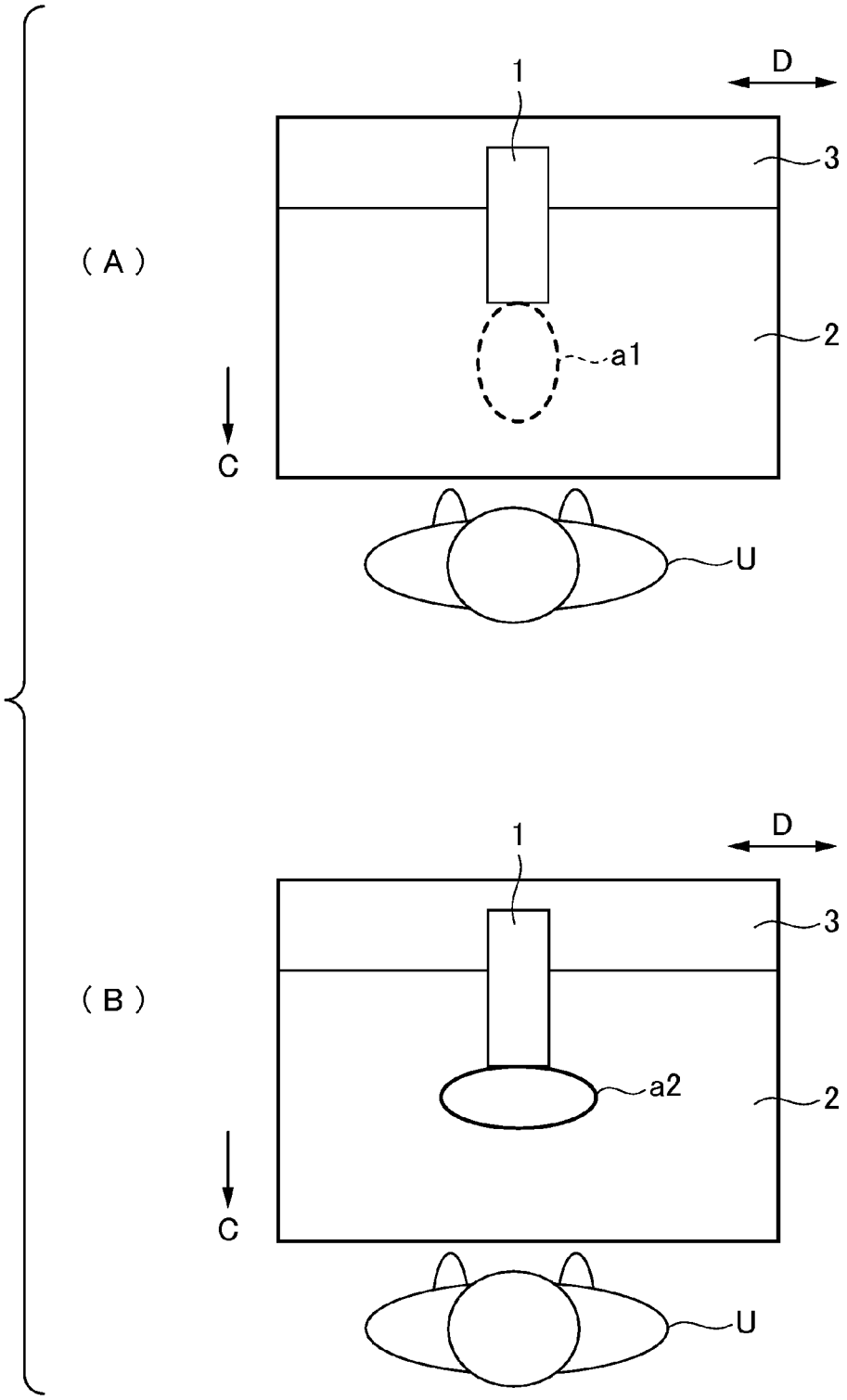
FIG. 3 is an explanatory top plan view of a usage state of the automatic faucet according to this embodiment.

FIG. 2 and FIG. 3(B) illustrate a sensing range a2 during the water spouting state. In this embodiment, the automatic faucet is configured such that a radio wave is emitted from the spout region in a given fixed direction, irrespective of during the water stopping state or during the water spouting state. However, as compared to the sensing range a1, the sensing range a2 is reduced in terms of size, and, accordingly, changed in terms of shape in such a manner that each a length along the spouting direction A and a length along a direction C oriented toward a user U becomes shorter. In addition, the sensing range a2 is changed in terms of shape in such a manner that an emitting direction B2 in the sensing range a2 is oriented toward a position which is spaced apart from the position where washing water reaches the bottom surface of the sink 2, in the direction C toward the user side, i.e., a forward direction. Thus, the sensing range a2 is reduced in terms of a region below a stream W, so that it becomes possible to prevent washing water rebounded after hitting the bottom surface of the sink 2 from being sensed. Further, the sensing range a2 is expanded in terms of a width, in a lateral direction D. In the following description, the lateral direction D will be referred to occasionally as "width direction" or to simply as "lateral direction".

A detailed structure of the automatic faucet 1 according to this embodiment will be described below.

Firstly, the conduit pipe 10 in this embodiment will be described. In this embodiment, dimensions of the conduit pipe 10, such as inner diameter and length, are set to allow the conduit pipe 10 to function as a waveguide for radio waves. That is, a transmitted radio wave emitted from the radio wave sensor 40 is propagated toward a downstream side through a radio wave propagation space defined between the inner peripheral surface of the conduit pipe 10 and an outer peripheral surface of the water pipe 20 so as to allow a radio wave to be propagated therethrough, while repeatedly undergoing reflection at the inner peripheral surface of the conduit pipe 10 and the outer peripheral surface of the water pipe 20, and emitted from a radio wave emitting port 27 provided at a distal end of the conduit pipe 10 in the vicinity of the spout port 26, toward the sink (see the emitting direction B1 in FIG. 4). Then, a radio wave reflected by a human hand (reflected wave) is introduced from the radio wave emitting port 27 into the conduit pipe 10, and propagated through the conduit pipe 10, whereafter it is received by the radio wave sensor 40.

In this embodiment, this structure can eliminate a need for installing a waveguide into the conduit pipe 10 which is a rigid body having the water pipe 20 inserted thereinto, thereby providing excellent assemblability. In addition, in this embodiment, the capability of eliminating the need for a waveguide makes it possible to facilitate downsizing and reduce production costs. Further, in this embodiment, the radio wave sensor 40 can be installed at a position other than the distal end portion of the conduit pipe 10, so that the distal end portion of the conduit pipe 10 can be particularly reduced in size. While it is preferable that the radio wave sensor 40 is installed outside the conduit pipe 10, it may be installed inside the conduit pipe 10.

Figure 13:
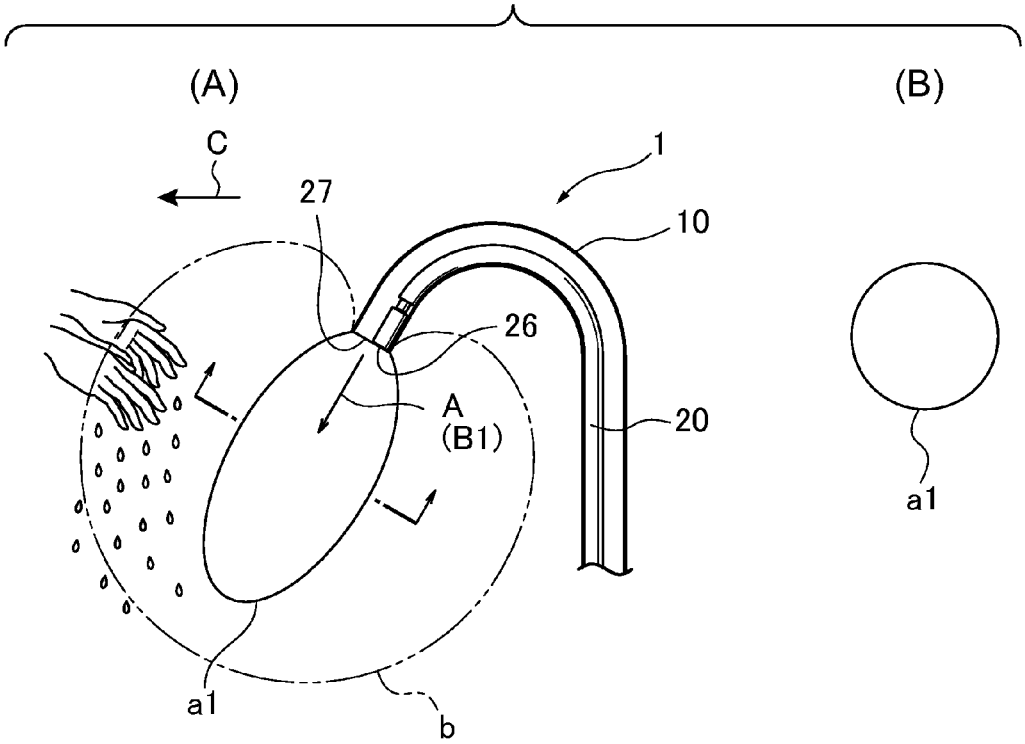
FIG. 13 is an explanatory diagram of the automatic faucet according to this embodiment during the water stopping state.

In this embodiment, a pattern of a radio wave beam emitted from the radio wave emitting port 27 of the conduit pipe 10 is set to become capable of sensing an object within the sensing range a1 illustrated in FIG. 13. More specifically, this sensing range a1 has directivity toward the emitting direction B1, and is set to elongatedly extend along the emitting direction B1. In this embodiment, the emitting direction B1 approximately conforms to the spouting direction A.

In this embodiment, in order to form the above sensing range a1 during the water stopping state, the automatic faucet 1 is provided with directivity setting means. In this embodiment, the directivity setting means comprises a reflecting member 28, and a double pipe structure in which the water pipe 20 is disposed inside the conduit pipe 10 (i.e., inside the radio wave emitting port 27), as described below.

Figure 4:
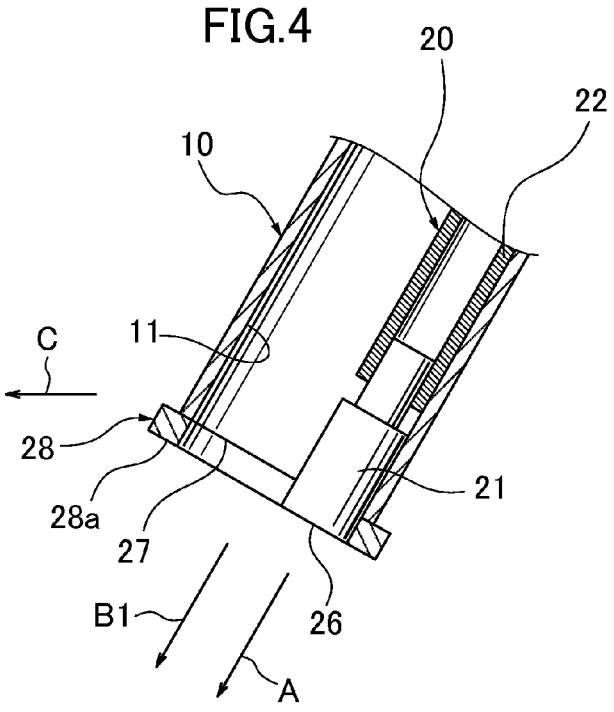
FIG. 4 is a sectional view of a vicinity of a spout port of the automatic faucet according to this embodiment.
Figure 5:
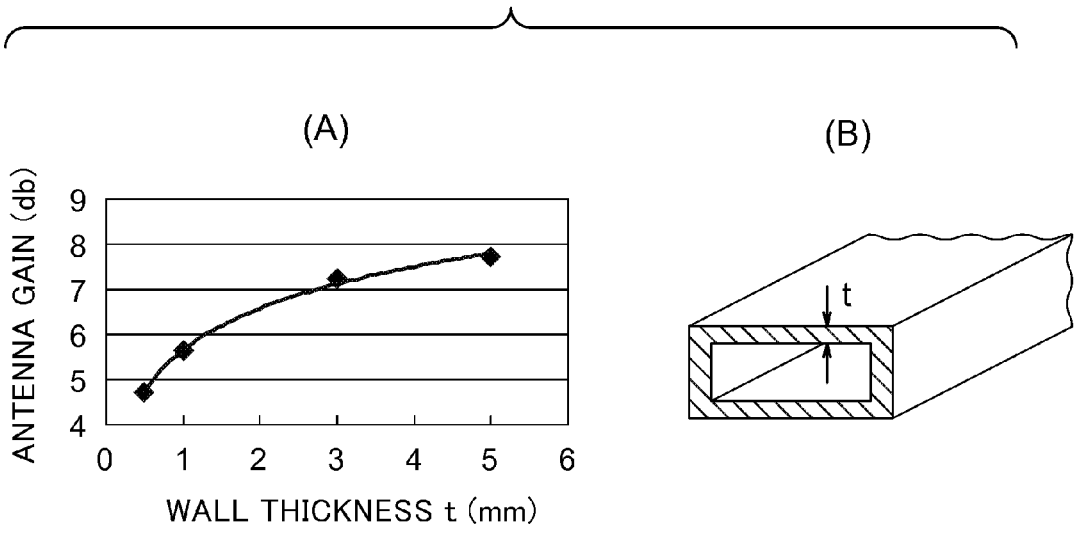
FIG. 5 is a graph illustrating a relationship between a wall thickness and an antenna gain of a waveguide.

Next, the reflecting member 28 will be described based on FIGS. 4 and 5. In this embodiment, the reflecting member 28 is formed as a ring-shaped separate component, and attached to the radio wave emitting port 27 of the conduit pipe 10. The reflecting member 28 is made of a material capable of reflecting a radio wave. In this embodiment, it is made of a metal material. The reflecting member 28 has a reflecting surface (reflecting portion) 28*a*. The reflecting surface 28*a* is a ring-shaped surface facing the sink 2. In this embodiment, a wall thickness (thickness in a radial direction) of the reflecting member 28 is set to be greater than a wall thickness (thickness in a radial direction) of the conduit pipe 10.

FIG. 5(A) illustrates an antenna gain of a radio wave sensor output from a sectionally rectangular waveguide (see FIG. 5(B)). FIG. 5(A) shows that, when a wall thickness t of an outlet portion of the waveguide is changed, the antenna gain becomes higher along with an increase in the wall thickness t. This means that, along with an increase in the wall thickness t, a radio wave beam becomes sharper, and thereby directivity toward an emitting direction becomes stronger.

In cases where a radio wave is emitted from a simple tubular body, a resulting radio beam pattern has almost no directivity, and expands to have a spherical shape. Therefore, in this embodiment, based on the result in FIG. 5, the reflecting member 28 is attached to the radio wave emitting port 27. The wall thickness of the reflecting member 28 is set depending on an inner diameter of the conduit pipe 10 to allow the sensing range a1 to be formed.

The reflecting surface 28*a* is adapted to suppress a situation where a radio wave propagated through the conduit pipe 10 exits the conduit pipe 10 and then turns back and goes around toward the upstream side of the conduit pipe 10 (a direction opposite to the emitting direction B1), and to set a direction of directivity of a radio wave. That is, the reflecting surface 28*a* functions to reflect a radio wave which is urged to move toward the upstream side, in a specific direction toward the bottom surface of the sink 2, to orient the direction of directivity in the specific direction, thereby providing directivity oriented in the emitting direction B1 to the radio beam pattern. As above, the reflecting member 28 has a function of sharpening the radio wave beam pattern along the emitting direction B1, thereby forming an adequate emitting pattern.

In this embodiment, a radio wave is concentrated along the spouting direction A by the reflecting member 28, so that it becomes possible to sense an object having relatively high radio wave permeability, such as a plastic toothbrush or cup, by a region having a stronger radio field intensity, in the sensing range a1. Further, in order to prevent erroneous water spouting due to erroneous sensing of a hand located away from the spout port 26, the sensing range a1 is set to be elongated along the spouting direction A.

In this embodiment, the reflecting member 28 as a separate component is attached to the distal end of conduit pipe 10. As an alternative to attaching the reflecting member 28, the conduit pipe 10 may be formed such that the distal end thereof has an increased wall thickness. Further, as long as the conduit pipe 10 has a wall thickness to an extent capable of suppressing going-around of the emitted radio wave, it is not necessary to attach the separate reflecting member, or thickly form only the distal end of the conduit pipe 10.

Figure 6:
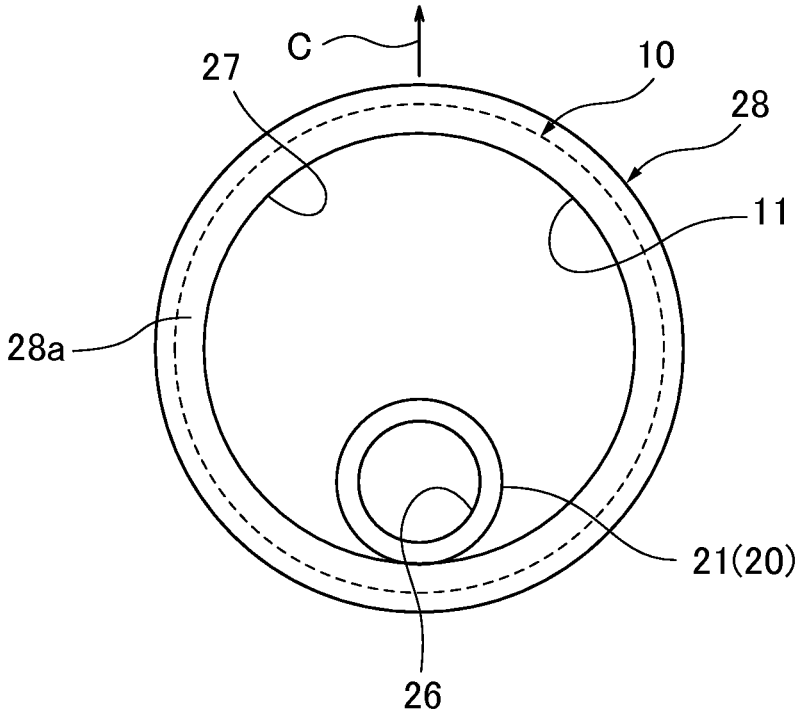
FIG. 6 is a diagram illustrating a radio wave emitting port of the automatic faucet according to this embodiment.
Figure 7:
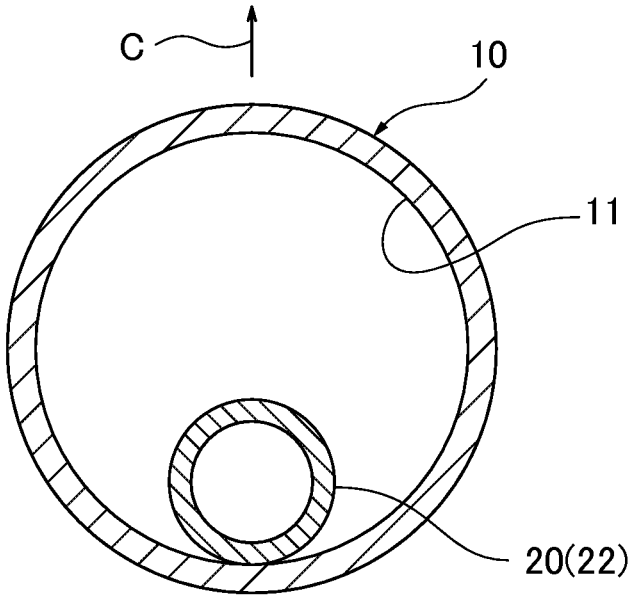
FIG. 7 is a sectional view of a conduit pipe of the automatic faucet according to this embodiment.

Next, with reference to FIGS. 6 to 8, the double pipe structure will be described below. FIG. 6 illustrates the outlet portion (downstream end portion) of the conduit pipe 10, and FIG. 7 is a sectional view of the conduit pipe 10, taken along the line VII-VII (see FIG. 1) at any intermediate position thereof.

In this embodiment, the water pipe 20 is disposed in contact relation with the inner peripheral surface 11 of the conduit pipe 10. As can be seen from FIG. 1, the outlet portion of the conduit pipe 10 extends obliquely forwardly and downwardly toward a bottom of the sink 2. Further, a position at which a user stands when he/she uses the automatic faucet 1 is set to be located in a direction along which the outlet portion extends.

In the outlet portion of the conduit pipe 10, the water pipe 20 is in contact with the inner peripheral surface 11 of the conduit pipe 10 (or an inner peripheral surface of the radio wave emitting port 27) at a position offset in a direction exactly opposite to the direction C (see FIGS. 4 and 6) toward a user's position. Further, as illustrated in FIG. 7, in the remaining region of the conduit pipe 10, the water pipe 20 is also in contact with the inner peripheral surface 11 of the conduit pipe 10.

In this embodiment, the radio wave beam pattern is adjusted by the double pipe structure where the water pipe 20 is disposed inside the conduit pipe 10 in the vicinity of the radio wave emitting port 27.

In this embodiment, based on the above configuration, a radio wave emitted from the radio wave emitting port 27 having an approximately circular outer shape is more likely to wrap around and interfere with a peripheral surface of a stream of washing water spouted from the spout port 26. Particularly, the radio wave is more likely to interfere with a user side-facing region (a region facing in the direction C toward the user side) and opposite lateral regions of the peripheral surface of the stream.

In FIG. 6, the spout port 26 (or the water pipe 20) has a diameter less than one-half of an inner diameter of the radio wave emitting port 27 (or the conduit pipe). Alternatively, the spout port 26 may be formed to have a diameter greater than one-half of the inner diameter of the radio wave emitting port 27, as illustrated in FIG. 8. In the configuration illustrated in FIG. 8, a radio wave is emitted, to the outside, from a substantially elongate, radio wave emitting window defined between the outer peripheral surface of the water pipe 20 and the inner peripheral surface of the conduit pipe 10. This elongate window forms a substantial radio wave emitting region of the radio wave emitting port 27.

Figure 8:
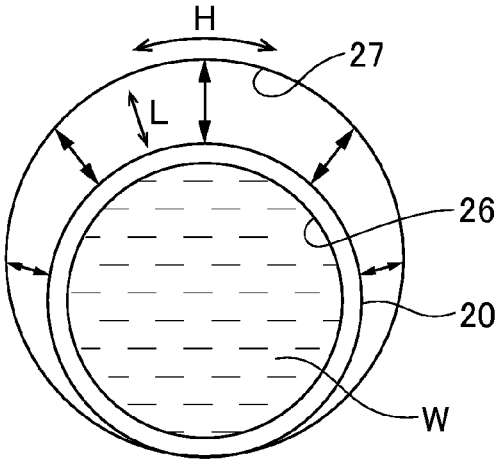
FIG. 8 is an explanatory diagram of a radio wave in a vicinity of the spout port in this embodiment.

In the example illustrated in FIG. 8, a size of the water pipe 20 with respect to the conduit pipe 10, or a size of the spout port 26 with respect to the radio wave emitting port 27, is set in such a manner that an electric field component or a polarization plane (indicated by the arrowed lines) of a radio wave propagated through the space between the inner peripheral surface of the conduit pipe 10 and the outer peripheral surface of the water pipe 20 crosses orthogonally to the outer peripheral surface of the water pipe 20. That is, as illustrated in FIG. 8, the elongate window has a shape in which a length in a horizontal (in FIG. 8) direction H is greater than that in a vertical (in FIG. 8) direction L, which can be considered as a shape obtained by bending a sectional shape of a rectangular waveguide. Thus, a radio wave mode in FIG. 8 is similar, for example, to the TE 01 mode in a rectangular waveguide.

Thus, in this embodiment, an electric field component of a radio wave can be brought into interference with a stream W of washing water spouted from the spout port 26, in an orthogonal state. This makes it possible to enhance radio wave attenuation and reflection characteristics to be obtained when a radio wave interferes with the stream W of the washing water, thereby making it easy to set directivity of a radio wave in the water spouting state. Particularly, in this embodiment, the electric field component is brought into interference with the stream W in an orthogonal state. This allows the radio wave to be more easily reflected by the peripheral surface of the stream W.

Figure 10:
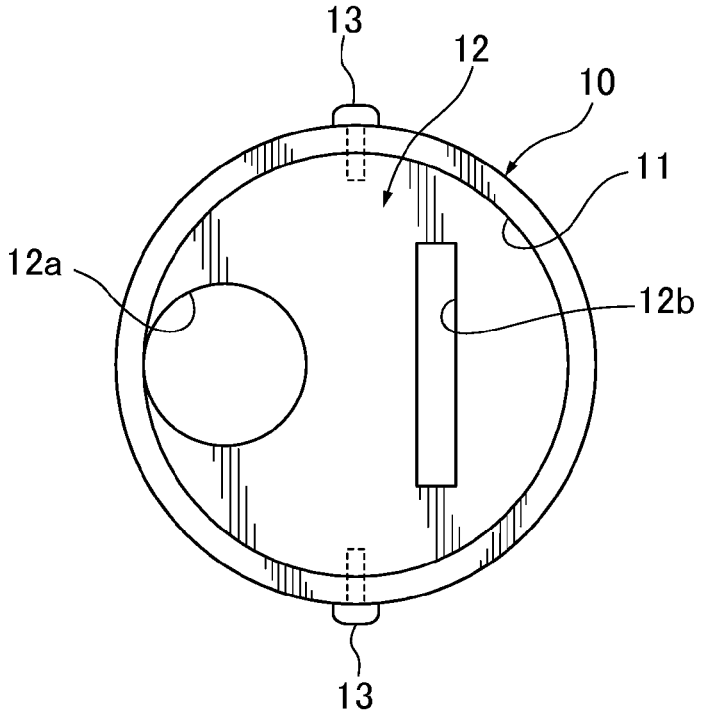
FIG. 10 is a front view of the inlet portion of the conduit pipe of the automatic faucet according to this embodiment.

Next, with reference to FIGS. 9 and 10, a structure of an inlet portion (upstream end portion) of the conduit pipe 10 will be described. FIG. 9 is a side sectional view, and FIG. 10 is a bottom view. In FIG. 10, the illustration of the water pipe 20 and the radio wave sensor 40 are omitted.

As illustrated in FIGS. 9 and 10, a fixing member 12 is fixed inside the inlet portion of the conduit pipe 10 by screws 13, to close up the conduit pipe 10. The fixing member 12 is a member having an outside dimension approximately equal to an inner diameter dimension of the conduit pipe 10, and made of a material capable of reflecting a radio wave. In this embodiment, the fixing member 12 is made of a metal material such as steel.

The fixing member 12 is formed with a circular open hole 12*a* and a rectangular open hole 12*b*. The fixing hole 12*a* has an inner diameter dimension approximately equal to an outside dimension of the water pipe 20, and the fixing hole 12*b* has inside dimensions approximately equal to respective outside dimensions of the radio wave input-output portion 42 of the radio wave sensor 40. The water pipe 20 and the radio wave sensor 40 are inserted into and fixed to corresponding ones of the open holes 12*a*, 12*b*. The water pipe 20 is in contact with the inner peripheral surface 11 of the conduit pipe 10 while being fixed to the open hole 12*a*.

The fixing member 12 functions as vibration reducing means to reduce vibration of the water pipe 20 caused by a water hammer phenomenon occurring upon closing of the spout valve 30. That is, vibration transmitted toward a downstream side from the spout valve 30 via the water pipe 20 upon closing of the spout valve 30 is transmitted via the fixing member 12 to the conduit pipe 10 and the washstand base 3 of the sink 2 each having a mass greater than that of the water pipe 20. This makes it possible to block the vibration from being transmitted toward the downstream side of the water pipe 20, thereby suppressing vibration of the water pipe 20. As a result of suppressing the vibration, it becomes possible to suppress a situation where the radio wave sensor 40 erroneously senses the presence of a human hand.

The water pipe 20, the radio wave sensor 40 and the conduit pipe 10 are fixedly coupled to each other by the fixing member 12, so that it becomes possible to synchronously vibrate the water pipe 20, the radio wave sensor 40 and the conduit pipe 10. This makes it possible to further suppress the situation where the radio wave sensor 40 erroneously senses the presence of a human hand.

In this embodiment, the radio wave input-output portion 42 of the radio wave sensor 40 is inserted into and fixed to the fixing member 12 in such a manner that a distal end opening 42*a* of the radio wave input-output portion 42 is located downstream of the fixing member 12. The distal end opening 42*a* of the radio wave input-output portion 42 is an exit/entrance for radio waves with respect to the conduit pipe 10. Thus, even if vibration caused by the water hammer phenomenon is transmitted to the fixing member 12, the radio wave sensor 40 becomes less likely to sense the vibration of the fixing member 12, so that it becomes possible to suppress false sensing.

In this embodiment, the fixing member 12 is installed as the vibration reducing means. Alternatively, any suitable damper member capable of absorbing and suppressing vibration may be attached to the water pipe 20 at a position between the spout valve 30 and the conduit pipe 10 to serve as the vibration reducing means.

Further, an additional fixing member for allowing the water pipe 20 to come into contact with the inner peripheral surface 11 of the conduit pipe 10 may be installed at an appropriate position inside the conduit pipe 10. In this case, differently from the fixing member 12, the additional fixing member is preferably made of a material having radio wave permeability (e.g., resin). The fixing member 12 has a surface made of a material capable of reflecting a radio wave, so that, although a radio wave introduced from the radio wave input-output portion 42 into the conduit pipe 10 is partially oriented toward the upstream side, such a radio wave can be reflected toward the downstream side. Thus, an intensity of radio wave to be emitted from the radio wave emitting port 27 can be maintained at a high level.

An operation of the automatic faucet 1 according to this embodiment will be described below.

FIG. 13 illustrates a state during the water stopping state. In FIG. 13(A), the sensing range a1 of the radio wave sensor 40 is illustrated. The sensing range a1 represents a range in which an object can be sensed by a radio wave beam emitted from the radio wave emitting port 27 of the conduit pipe 10, during the water stopping state.

In this embodiment, the directivity setting means is configured to allow a spatial emission pattern of a radio wave beam emitted from the radio wave emitting port 27, to have directivity toward the emitting direction B1 during the water stopping state. In this embodiment, during the water stopping state, the emitting direction B1 approximately conforms to the spouting direction A along which washing water is to be spouted from the spout port 26.

Thus, a radio wave beam during the water stopping state has directivity along the spouting direction A, and the sensing range a1 is set to have an elongate shape like an oval sphere extending along the spouting direction A. That is, it has an elongate shape like an oval sphere in which each equi-radio field intensity contour extends along the spouting direction A within the sensing range a1. As illustrated in FIG. 13(B), a cross-section of the sensing range a1 orthogonal to the emitting direction B1 has an approximately circular shape. FIG. 13(B) is a sectional view of the sensing range a1 taken along the arrowed line in FIG. 13(A).

In this embodiment, the sensing range a1 extending to form an elongate oval sphere-like shape has a cross-sectional area (along a direction orthogonal to the emitting direction B1) which maximally increases in an intermediate region in the emitting direction B1, and gradually decreases in a direction away from the intermediate region.

In this specification, the term "equi-radio field intensity contour" means a contour line formed by connecting a plurality of spatial points each having an equal radio field intensity in a radio wave beam. Further, in this specification, the term "elongate shape" means a shape in which a length in a certain direction is greater than a length in a direction orthogonal to the certain direction, such as an oval sphere.

Figure 14:
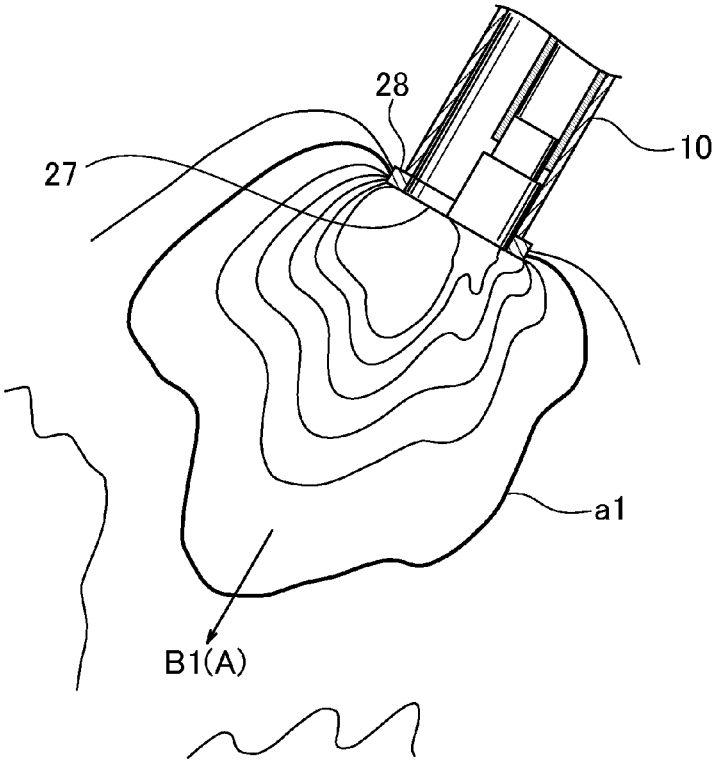
FIG. 14 is a diagram illustrating a radio field intensity distribution in the vicinity of the spout port in this embodiment during the water stopping state.

FIG. 14 corresponds to FIG. 13, and illustrates a detailed radio field intensity distribution of a radio wave emitted from the radio wave emitting port 27 during the water stopping state. The same sensing range a1 as that in FIG. 13(A) is also illustrated in FIG. 14.

Figure 15:
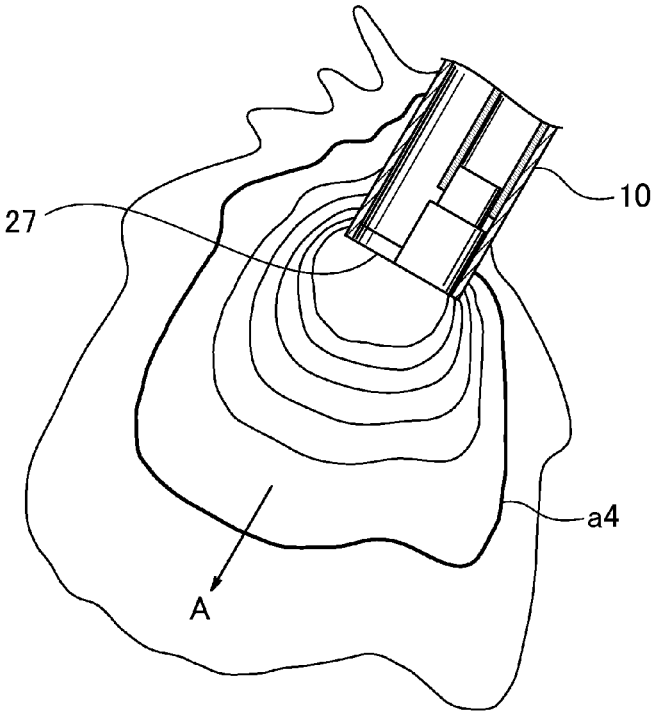
FIG. 15 is a diagram illustrating a radio field intensity distribution in the vicinity of the spout port, wherein a reflecting member is removed.

For comparison, FIG. 15 illustrates a radio field intensity distribution in an automatic faucet devoid of the reflecting member 28. In FIG. 15, a radio wave emitted from the radio wave emitting port 27 expands in a radial pattern to form a sensing range a4 close to a spherical shape, and goes around backwardly with respect to the radio wave emitting port 27 (in a direction opposite to the spouting direction A) along an outer peripheral surface of the conduit pipe 10. On the other hand, in FIG. 14 (in the automatic faucet having the reflecting member 28), a radio wave is enhanced in terms of directivity toward the emitting direction B1 to have the elongatedly-extending sensing range a1, without going around backwardly along the outer peripheral surface of the conduit pipe 10. This shows that directivity of a radio wave toward the spouting direction A can be enhanced to sharpen a radio wave beam pattern, by providing the reflecting member 28.

The sensing range a1 is a spatial range delimited by an outermost one of the equi-radio field intensity contours within which the radio wave sensor 40 can significantly sense a human hand. When a user inserts his/her hand into the sensing range a1 in order to perform hand washing, the radio wave sensor 40 senses a movement of the hand, and sends a detection signal to the control section 50. Upon receiving the detection signal, the control section 50 sends a driving signal to the spout valve 30 to switch the spout valve 30 to an open state. Thus, in response to a situation where the hand reaches the vicinity of the spout port 26, washing water is spouted from the spout port 26 in a timely manner.

Due to a narrow sensing range, a conventional automatic faucet using a photoelectric sensor is incapable of, in response to approaching of a user's hand, starting water spouting in a timely manner. Differently, in this embodiment, the sensing range a1 is set to expand in a radial direction with respect to the spouting direction A, so that, even if a user inserts his/her hand from any direction, approaching of the user's hand can sensed at an earlier stage before the hand reaches a washing point located on an extension line extending from the spout 26 in the spouting direction A, and can start water spouting in a timely manner.

In the case where a radio wave is emitted simply from the outlet end of the conduit pipe 10, a radio wave beam spherically expands while going around backwardly, as indicated by a sensing range b, so that a user's water removing motion in the vicinity of the spout port 26 is undesirably sensed (see FIG. 13(A)).

Differently, in this embodiment, the sensing range a1 during the water stopping state is set to a shape elongate in the spouting direction A, such as an oval sphere, so that it becomes possible to increase the radio wave emission intensity at the washing point, as measured at a position away from the spout port 26 by the same distance. Thus, the water removing motion will be performed outside the sensing range a1, so that it becomes possible to prevent spouting of washing water from being continued during the water removing motion. As above, in this embodiment, it becomes possible to facilitate sensing of a user's hand when it is located at a position requiring water spouting, and avoid sensing of the user's hand when it is located at a position requiring no water spouting.

Figure 16:
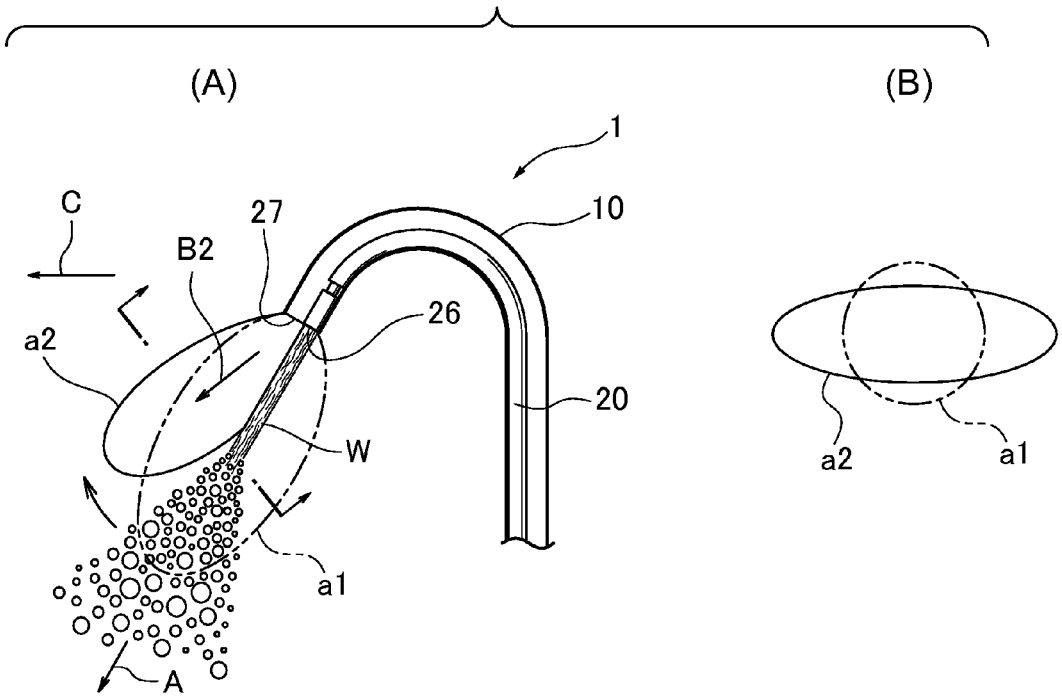
FIG. 16 is an explanatory diagram of the automatic faucet according to this embodiment during the water spouting state.

FIG. 16 illustrates a state in which washing water W is being spouted from the spout port 26. In FIG. 16(A), the sensing range a2 within which a movement of an object can be sensed by a radio wave beam is illustrated.

In this embodiment, the sensing range a2 is set in such a manner that, by utilizing interference between a radio wave in the sensing range a1 and washing water spouted from the spout port 26, the radio wave is partially attenuated, and reflected by the washing water. The attenuation of the radio wave causes the radio wave emission intensity to become weak to thereby reducing the emission pattern (sensing range), and the reflection of the radio wave causes a position of the emission pattern to be displaced and offset above the stream W of the washing water or in the direction C toward the user side. As a result, the sensing range a2 extends in a different angular direction, and becomes different from the sensing range a1 in terms of position, i.e., at least a part of the sensing range a2 is spatially offset with respect to the sensing range a1, although it partially overlaps the sensing range a1.

That is, in this embodiment, by utilizing a radio wave's property that a radio wave is attenuated and reflected by washing water during interference therebetween, the sensing range a2 during the water spouting state is set to become different from the sensing range a1 during the water stopping state, in terms of size, direction, shape, etc. As above, in this embodiment, an adequate sensing range is automatically set depending on whether water spouting is stopped or continued (the presence or absence of spouting of washing water).

In this embodiment, the washing water stream W from the spout port 26 passes through an approximately central region of the sensing range a1 during the water stopping state, so that an amount of attenuation in the sensing range a1 can be increased in the spouting direction A, as compared to in a direction orthogonal to the spouting direction A. Thus, water rebounded from the sink 2 or a stream of water flowing along the bottom surface of the sink 2 becomes less likely to be sensed.

In this embodiment, as illustrated in FIG. 16(A), the sensing range a2 is set such that the emission intensity in the emitting direction B2 during the water spouting state is relatively increased, and a detectable distance of the sensing range a2 in the emitting direction B2 becomes less than a detectable distance of the sensing range a1 in the emitting direction B1. For this purpose, in this embodiment, a size, position (in the emitting direction B2), shape, etc., of the sensing range a2, is set by preliminarily setting a direction of directivity of the radio wave by the reflecting member 28, an angle and level of interference between the radio wave and the washing water stream W, a flow rate of the washing water stream W, a size of the radio wave emitting port 27 with respect to the spout port 26, etc., without changing parameters of the radio wave sensor 40 and the control section 50, such as the radio field intensity. Therefore, in this embodiment, the sensing areas a1, a2 can be switched therebetween only depending on the presence or absence of water spouting, without a need for an additional functional component, so that it becomes possible to realize both desired sensing ranges during the water stopping state and during the water spouting state, with a simple configuration without impairing design flexibility of the automatic faucet 1.

As illustrated in FIG. 16, the sensing range a2 is tilted in the direction C toward the user side, with respect to the sensing range a1, so that the sensing range a2 includes a space closer to the user side in the direction C, as compared to the sensing range a1.

Figure 17:
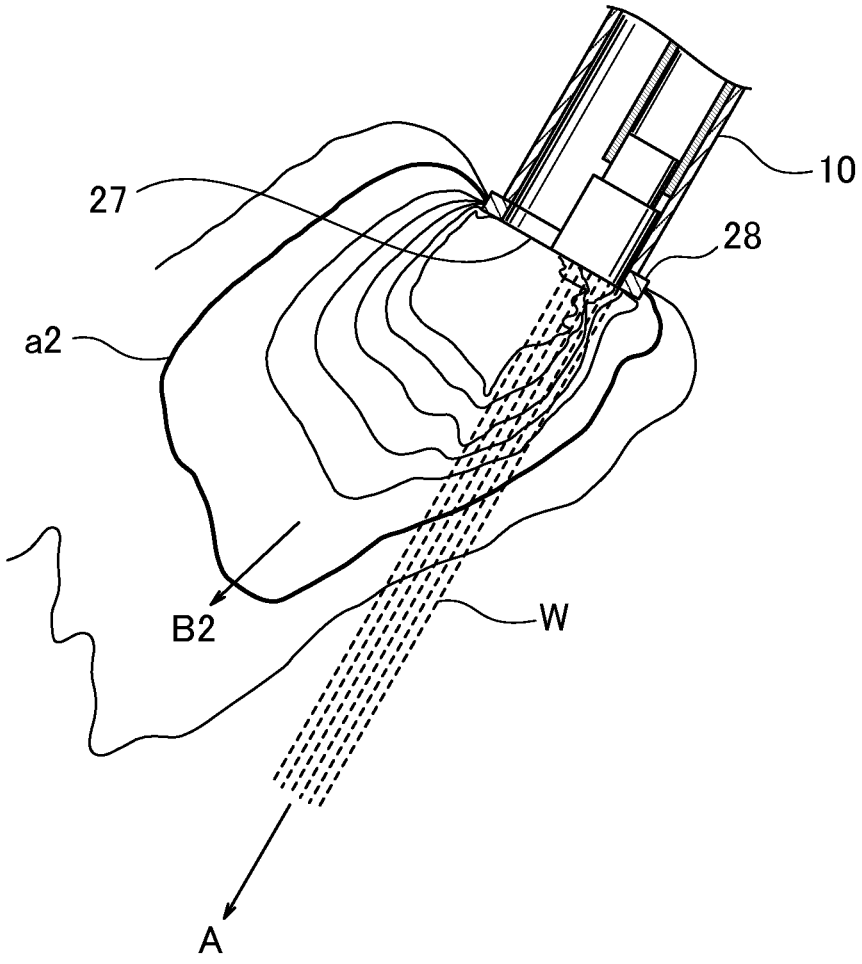
FIG. 17 is a diagram illustrating a radio field intensity distribution in the vicinity of the spout port in this embodiment during the water spouting state.

FIG. 17 corresponds to FIG. 16, and illustrates a detailed radio field intensity distribution of a radio wave emitted from the radio wave emitting port 27 during the water spouting state. The same sensing range a2 as that in FIG. 16(A) is also illustrated in FIG. 17. As can be seen from FIG. 16, during the water spouting state, a radio wave beam pattern directed in the emitting direction B2 is formed.

As illustrated in FIG. 6, the radio wave emitting port 27 is configured such that it is located relatively offset in the direction C toward the user side, with respect to the spout port 26. That is, in this embodiment, the spout port 26 is located offset toward a side opposite to the user side with respect to the radio wave emitting port 27 (i.e., a direction from the spout port 26 toward the base end of the faucet main unit 1A) (see FIGS. 4 and 6), so that the washing water stream W passes through a region of the sensing range a1 offset toward the base end of the faucet main unit 1A. Thus, during the water spouting state, a radio wave beam emitted from the radio wave emitting port 27 is reflected in the direction C toward the user side by the washing water stream W, to form the sensing range a2 having a direction or angle changed to the emitting direction B2 tilted in the direction C toward the user side.

More specifically, a radio wave emitted from a region of the radio wave emitting port 27 located just above (in FIG. 6) the spout port 26 is reflected to have the emitting direction B2 or reflected in the direction C toward the user side by washing water, so that the sensing range a2 during the water spouting state has directivity toward the emitting direction B2. The sensing range a2 is set in the above manner, so that it is moved away from the sink 2 as a whole to include a space closer to the user side. Thus, as long as a user inserts his/her hand in the washing water stream W, the hand is reliably located in the sensing range a2, so that it becomes possible to continuously sense the hand during hand washing.

The stream of washing water spouted obliquely forwardly and downwardly from the spout port 26 gradually deviates from the spouting direction A in a downstream direction thereof due to gravity (see FIG. 2). Therefore, the washing water stream passes through a position which becomes farther away from a central region having a high radio field intensity, in the downstream direction as a direction approaching the bottom surface of the sink 2. This makes it possible to suppress attenuation of the radio wave at a position away from the spout port 26 (at a position close to the bottom surface of the sink 2), thereby preventing the sensing range from being excessively reduced in the spouting direction. Thus, a hand washing motion at a position far away from the spout port 26 can be reliably sensed to continue water spouting.

In this embodiment, the spout port 26 is disposed within the radio wave emitting port 27, so that a radio wave from the radio wave emitting port 27 is emitted to cover a periphery of the spout port 26. Thus, during the water spouting state, the washing water stream W passes through a space having the emitted radio wave, so that it becomes possible to increase an area of interference between the radio wave and the washing water.

Further, as illustrated in FIG. 6, the spout port 26 is located offset from a central region of the radio wave emitting port 27. Therefore, in each of the sensing ranges a1, a2, a radio wave in the central region having the highest radio field intensity is less likely to come under the influence of attenuation by washing water, at least in the vicinity of the spout port 26. Thus, the region having high radio field intensity is maintained in the vicinity of the spout port 26, so that it becomes possible to reliably sense a resin product having a low radio wave reflection rate, such as toothbrush, during the water spouting state.

In this embodiment, the washing water stream W passes through the region of the sensing range a1 offset toward the faucet main unit 1A. Thus, during the water spouting state, a radio wave can be attenuated by the washing water W, at a larger rate in a lower region of the sensing range a1 offset toward the faucet main unit 1A than in an upper region of the sensing range a1 offset in the direction C toward the user side. As above, the directivity setting means (double pipe structure) in this embodiment functions as up-down directional attenuation ratio adjusting means for adjusting a ratio of respective attenuations of two regions of the sensing range in an up-down direction.

As illustrated in FIG. 6, the radio wave emitting port 27 is also located on a lateral or horizontal side of the spout port 26. A radio wave emitted from a region of the radio wave emitting port 27 located on the lateral or horizontal side (in FIG. 6) of the spout port 26 is reflected in a lateral direction by the washing water stream W, so that the radio wave beam emission pattern is expanded in the lateral direction. As above, the directivity setting means (double pipe structure) in this embodiment functions as means to adjust a lateral shape of the sensing range. Further, the radio wave is at least partially attenuated by the washing water stream W, so that the sensing range is reduced as a whole. For example, the radio wave beam emission pattern is narrowed rather than expanded, in the thickness direction (direction orthogonal to the emitting direction and the lateral direction). As a result, as illustrated in FIG. 16(B), the radio wave beam emission pattern (sensing range a2) has a flattened shape in which a cross-section orthogonal to the emitting direction B2 is laterally stretched as compared to that in FIG. 13(B). FIG. 16(B) is a sectional view of the sensing range a2 taken along the arrowed line in FIG. 16(A).

FIG. 18(A) illustrates a cross-section of the sensing range a1 during the water stopping state in a direction perpendicular to the spouting direction A, and FIG. 18(B) illustrates a cross-section of the sensing range a2 during the water spouting state at the same position as that in FIG. 18(A). During the water stopping state, when the radio wave emitting port 27 is viewed from the spouting direction A, the cross-section of the sensing range a1 is a circular shape having a radius R1 from a center of the radio wave emitting port 27, and has a lateral width W1.

On the other hand, during the water spouting state, as schematically indicated by the arrowed lines in FIG. 18(B), a radio wave emitted from the radio wave emitting port 27 is reflected by the washing water stream W. As a result, the cross-section of the sensing range a2 is deformed into an oval shape in which a distance from the center of the radio wave emitting port 27 to a boundary thereof facing in the direction C toward the user side is R2, and a lateral width is W2. Preferably, the following relations are satisfied: R2>R1, and W2>W1. In the sensing range a2, a main region with respect to the washing water stream W is located offset in the direction C toward the user side, and almost no region exists in a direction opposite to the direction C toward the user side.

Figure 18:
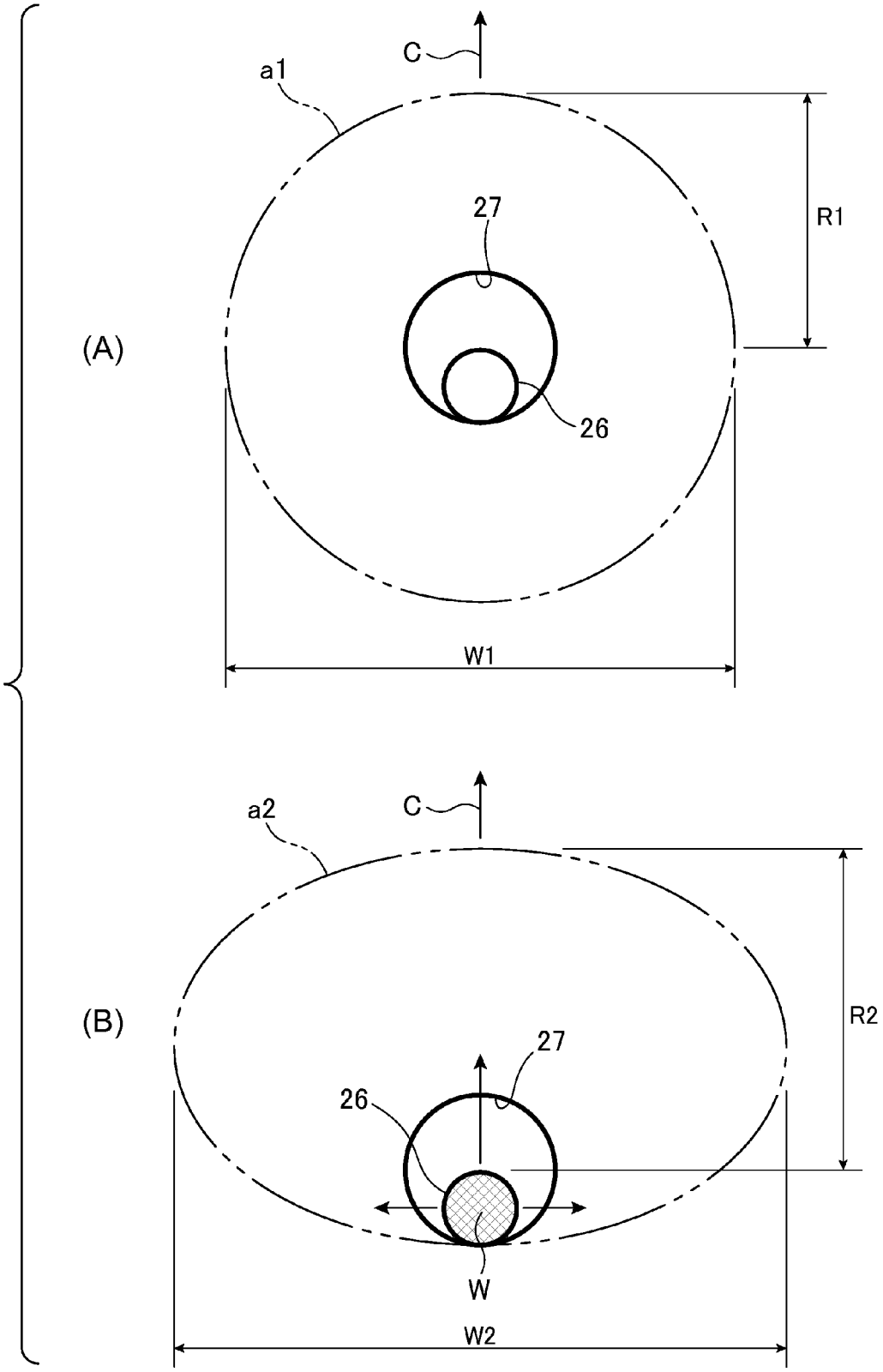
FIG. 18 is an explanatory diagram of a sensing range in the automatic faucet according to this embodiment.
Figure 19:
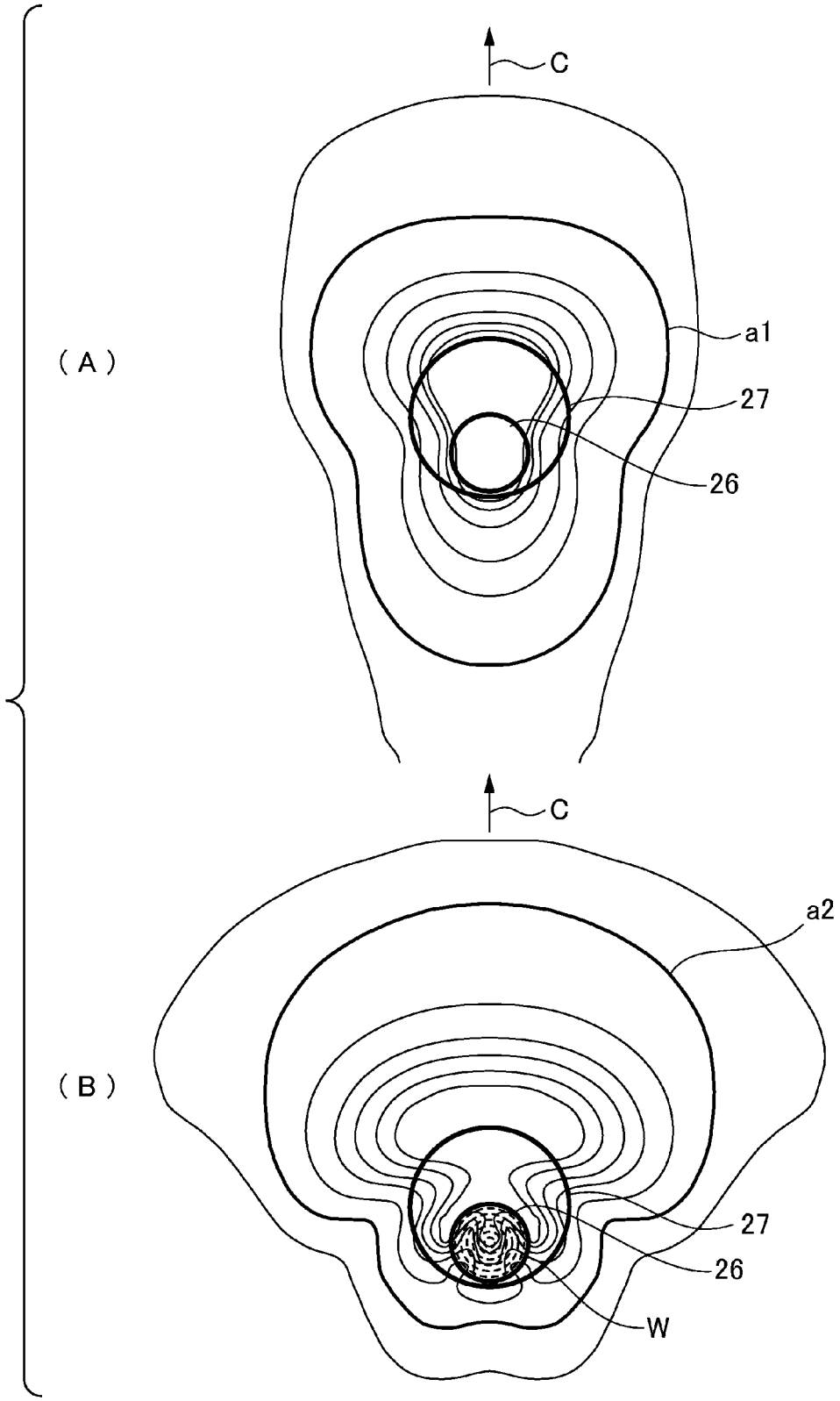
FIG. 19 is a diagram illustrating a radio field intensity distribution in the vicinity of the spout port in this embodiment.

FIG. 19 corresponds to FIG. 18, and illustrates detailed radio field intensity distributions of a radio wave emitted from the radio wave emitting port 27 during the water stopping state (FIG. 19(A)) and the water spouting state (FIG. 19(B)). The same sensing ranges a1, a2 as those in FIG. 18 are also illustrated in FIG. 19. As can be seen from FIG. 19, during the water spouting state, the radio wave is expanded in the lateral direction and in the direction C toward the user side.

Figure 20:
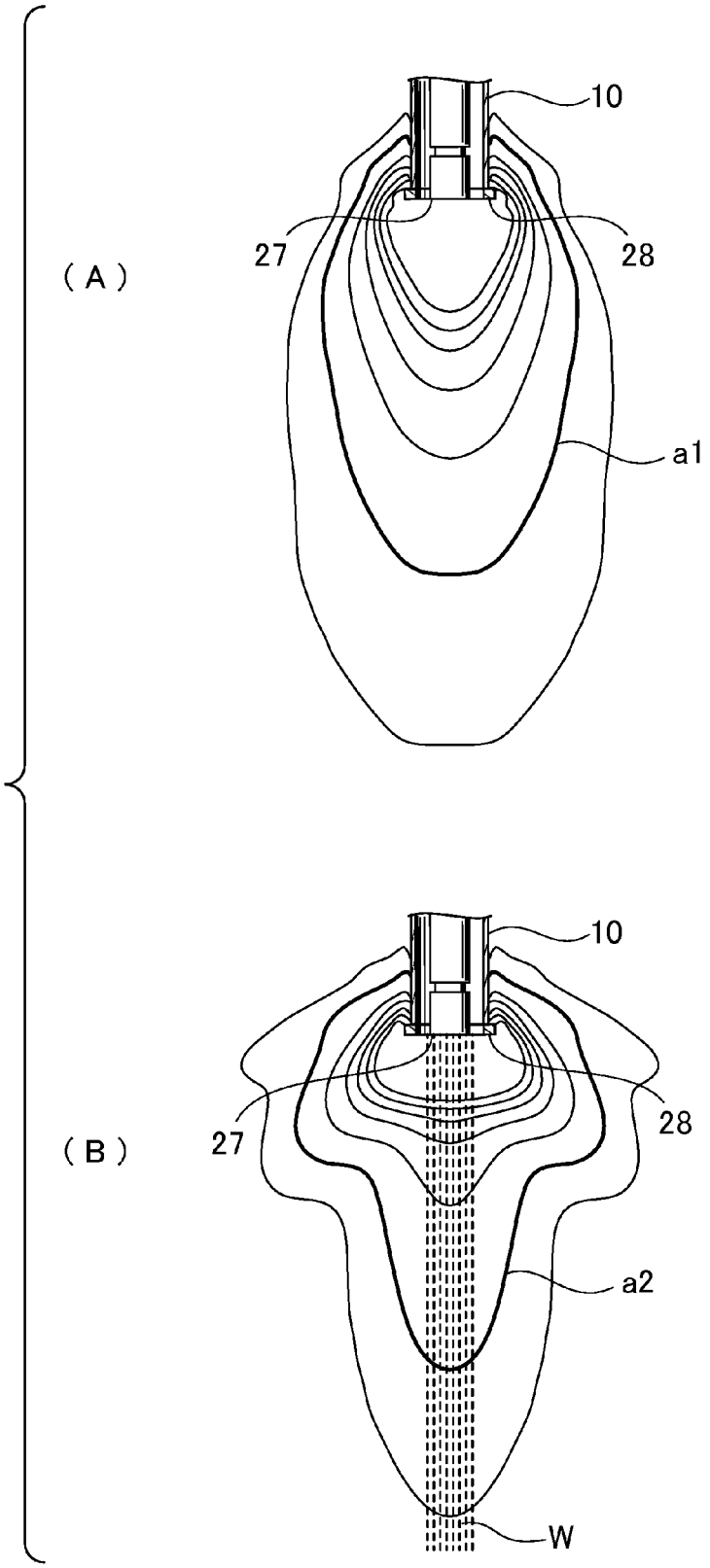
FIG. 20 is a diagram illustrating a radio field intensity distribution in the vicinity of the spout port in this embodiment.

FIGS. 20(A) and 20(B) illustrate, respectively, a radio field intensity distribution during the water stopping state and a radio field intensity distribution during the water spouting state, when a vicinity of the radio wave emitting port 27 during the water stopping and water spouting states is viewed from thereabove. As with FIG. 19, FIG. 20 shows that, during the water spouting state, the radio wave is expanded in the lateral direction.

In this embodiment, in the above double pipe structure, the spout port 26 is provided within the radio wave emitting port 27, and disposed offset in a direction opposite to the direction C toward the user side, to come into contact with or close to the inner peripheral surface of the conduit pipe 10. Therefore, a radio wave is emitted from the radio wave emitting port 27 to a region the peripheral surface of the washing water stream W facing in the direction C toward the user side, thereby causing interference therewith. In addition, the radio wave is also emitted toward a lateral region of the peripheral surface of the washing water stream W, thereby causing interference therewith. Thus, in this embodiment, the sensing range a2 is expanded in the direction C toward the user side by the radio wave reflected in the direction C toward the user side, and also expanded in the lateral direction by the radio wave reflected in the lateral direction. In this embodiment, a radio wave is emitted in the direction C toward the user side to allow the sensing range a2 to have a user side-facing sensing region (a sensing region facing in the direction C toward the user side) greater than that of the sensing range a1, so that sensing in a space offset in the direction C toward the user side is facilitated during the water spouting state, as compared to during the water stopping state. As above, the directivity setting means (double pipe structure) in this embodiment functions as reflection-based directivity setting means to expand the sensing range in the direction C toward the user side, as well as the means to adjust a lateral shape of the sensing range.

In this embodiment, in the radio wave emitting port 27, a space defined in the direction C toward the user side with respect to the spout port 26 is greater than a lateral space with respect to the spout port 26, so that a radio wave emitted from the space defined in the direction C toward the user side with respect to the spout port 26 is reflected by the washing water stream W, in an amount greater than that of a radio wave emitted from the lateral space with respect to the spout port 26.

In this embodiment, during the water spouting state, the sensing range a2 is expanded in the lateral direction and displaced upwardly and in the direction C toward the user side, so that, even if a user moves his/her hand from the vicinity of the spout port 26 laterally or upwardly to perform a hand-lathering motion during hand washing or the like, water spouting can be continued. This makes it possible to continuously sense the hand until the hand certainly moves away from the vicinity of the spout port 26 after completion of hand washing, to maintain the water spouting state.

In this specification, the term "width direction or lateral direction" means a lateral direction of a user facing to the conduit pipe 10. FIGS. 1 and 2, it is a direction perpendicular to each of the drawing sheets thereof, and, in FIGS. 6 to 8, it is a lateral direction on each of the drawing sheets thereof. Further, in FIG. 3, it is illustrated as the lateral direction D.

In this embodiment, as mentioned above, during the water spouting state, the radio wave beam sensing range is narrowed through attenuation of the radio wave caused by the washing water stream W, and the radio wave beam is displaced upwardly through reflection of the radio wave caused by the washing water stream W. Thus, in the spouting direction A, a detectable distance during the water spouting state is set to become less than that during the water stopping state. That is, the directivity setting means in this embodiment functions as spouting-directional attenuation amount adjusting means to appropriately set a level of attenuation (based, for example, on setting of a dimensional ratio between the spout port 26 and the radio wave emitting port 27) so as to reduce a length of the sensing range in the spouting direction.

In this embodiment, as illustrated in FIG. 16(A), the automatic faucet is configured such that, during the water spouting state, the washing water stream W passes through a radio wave emitting region, i.e., the sensing range a1 during the water stopping state. This configuration allows the sensing range a2 during the water spouting state to be reduced in the spouting direction A at a larger rate than in a direction orthogonal to the spouting direction A, with respect to the sensing range a1 during the water stopping state. That is, in this embodiment, it becomes possible to facilitate reducing the sensing range a2 during the water spouting state, in the spouting direction A, as compared to a direction orthogonal to the spouting direction A. This means that the directivity setting means in this embodiment functions as spouting direction-to-radial direction attenuation ratio adjusting means for adjusting a ratio of respective attenuations the sensing range in the spouting direction and a direction orthogonal to the spouting direction A.

In this embodiment, the detectable distance is set to a larger value during the water stopping state, so that it becomes possible to, when a user gradually moves his/her hand from a distant position toward the spout port 26, detect the hand at an earlier stage to start spouting water. On the other hand, the detectable distance is set to a smaller value during the water spouting state, so that it becomes possible to reliably sense a human hand located adjacent to the spout port 26, and prevent false sensing of a human hand far away from the spout port 26 or the stream, and resulting delay of stop of water spouting.

Further, as illustrated in FIG. 16(A), in the stream W of washing water spouted from the spout port 26, a flow thereof naturally becomes more disordered in the downward direction as a direction approaching the sink 2, depending on a flow rate thereof. That is, the washing water W is formed into droplets on the side of the sink 2, and water droplets are spread in the radial direction. In addition, the washing water is rebounded from the sink 2. Therefore, the radio wave sensor 40 might be likely to erroneously sense the disorder of the washing water stream W or the rebound of the washing water, as a movement of a human hand.

However, in this embodiment, during the water spouting state, a radio wave beam is attenuated on the side of the base end of the faucet main unit 1A, and displaced upwardly and in the direction C toward the user side, thereby setting the detectable distance to a smaller value. This makes it possible to avoid false sensing due to the disorder of the washing water stream W or the rebound of the washing water to prevent delay of the stop of water spouting.

In this embodiment, as illustrated in FIG. 6, the spout port 26 is disposed in a part of an inner space of the radio wave emitting port 27, and the radio wave emitting port 27 has a widthwise length greater than that of the spout port 26, so that a part of a radio wave is emitted toward the emitting direction B1 (i.e., the spouting direction A) in approximately the same manner as that during the water stopping state. Thus, when a user receives water by a container, a radio wave emitted in the spouting direction A is reflected at a water surface in the container, so that the radio wave sensor 40 can sense an object in accordance with ruffling of the water surface. Therefore, during the operation of receiving water in the container, the water spouting state can be continued.

In this embodiment, as illustrated in FIG. 6, the spout port 26 has a cross-sectionally circular shape. Thus, a radio wave is emitted, but slightly, toward the emitting direction B1 from around a lower portion (except a lowermost position) of the spout port 26. Thus, the radio wave beam emission pattern can also be ensured in a vertical direction (including a lower side of the washing water stream W). However, in this embodiment, the spout port 26 is in contact with a lowermost region (in FIG. 6) of the inner peripheral surface of the radio wave emitting port 27, so that it becomes possible to suppress a radio wave from being propagated vertically downward of the spout port 26 during the water stopping state. Thus, even in a situation where water droplets drop from the spout port 26 after stop of water spouting, such a movement of the droplets is not sensed, which prevents water spouting from being needlessly started.

Next, a setting method for the water-spouting stop threshold Tt in this embodiment will be described.

One factor causing difficulty in reliably stopping washing water after completion of hand washing is rebound of water from the sink 2. That is, due to an influence of the water rebound, an amplitude of a detection signal is increased. Therefore, in order to reliably stop water even if the water rebound occurs, the water-spouting stop threshold may be set to a value greater than that of a detection signal generated under the influence of water rebound.

However, if the water-spouting stop threshold is set to a large value, the following problem will undesirably occur. Generally, hand washing is performed at a position relatively far away from the spout port 26. However, a tooth brush is washed at a position close to the spout port 26 where washing water is vigorously flowing. Thus, if the water-spouting stop threshold is set to a large value, the sensing range is substantially narrowed, so that it becomes impossible to sense hand washing to be performed at a position away from the spout port 26, which causes stop of water spouting, resulting in poor usability. The tooth brush is a sensing target object made of a resin material having a low radio wave reflection rate, and thereby a detection signal of the tooth brush has a small amplitude. Thus, if the water-spouting stop threshold is set to a large value, it becomes impossible to sense the tooth brush, which causes stop of water spouting.

Therefore, in this embodiment, the water-spouting stop threshold Tt is set while taking into account the fact that washing for a tooth brush or the like is performed at a position close to the spout port 26, instead of at a position relatively far away from the spout port 26. Specifically, the water-spouting stop threshold Tt is set to a range of a value less than a detection signal to be generated in response to detection of hand washing performed at a position far away from the spout port 26, to a value greater than a detection signal to be generated in response to detection of washing water reaching the bottom surface of the sink 2 without any obstruction, and a value which falls within the range and is less than a detection signal to be generated in response to detection of a sensing target object (e.g., tooth brush) having a low radio wave reflection rate, inserted in a position close to the spout port 26.

In this embodiment, the sensing range a2 during the water spouting state is set to become shorter in the spouting direction A than the sensing range a1 during the water stopping state, and directed in a direction deviating from the spouting direction (emitting direction B2). This sensing range a2 is set such that a detection signal to be generated in response to detection of the tooth brush inserted in a position close to the spout port 26, in the above state, become greater than the water-spouting stop threshold Tt set in the above manner. In this way, the sensing range a2 and the water-spouting stop threshold Tt can be mutually adjusted to finally determine an optimal sensing range a2 and water-spouting stop threshold Tt.

As above, in this embodiment, the sensing range a2 is narrowed with respect to the sensing range a1. This makes it possible to prevent sensing of water rebound in the vicinity of the bottom surface of the sink 2, thereby reliably stopping washing water after completion of hand washing. In addition, even if hand washing is performed at a position away from the spout port 26, it becomes possible to continue water spouting during the hand washing, because a detection signal having a relatively large amplitude can be sensed during the hand washing, and the water-spouting stop threshold Tt is not a high value. Further, in the vicinity of the spout port 26, a region having a strong radio field intensity exists around the radio wave emitting port 27. Thus, the tooth bush can be sensed by the region having a strong radio field intensity, to continue water spouting.

A modified embodiment will now be described based on FIG. 21. In this embodiment, the radio wave attenuating effect by the washing water stream W is significantly exhibited. In this embodiment, a water pipe 20 is installed to pass through a central region of a conduit pipe 10, and a spout port 26 is disposed in a central region of a radio wave emitting port 27 (see FIG. 21(B)). Even if the position of the water pipe 20 is displaced to the central region of the radio wave emitting port 27, this arrangement has almost no influence on a sensing range during a water stopping state. Thus, a sensing range during the water stopping state illustrated in FIG. 21(A) is substantially the same as the sensing range a1 in FIG. 13.

Figure 21:
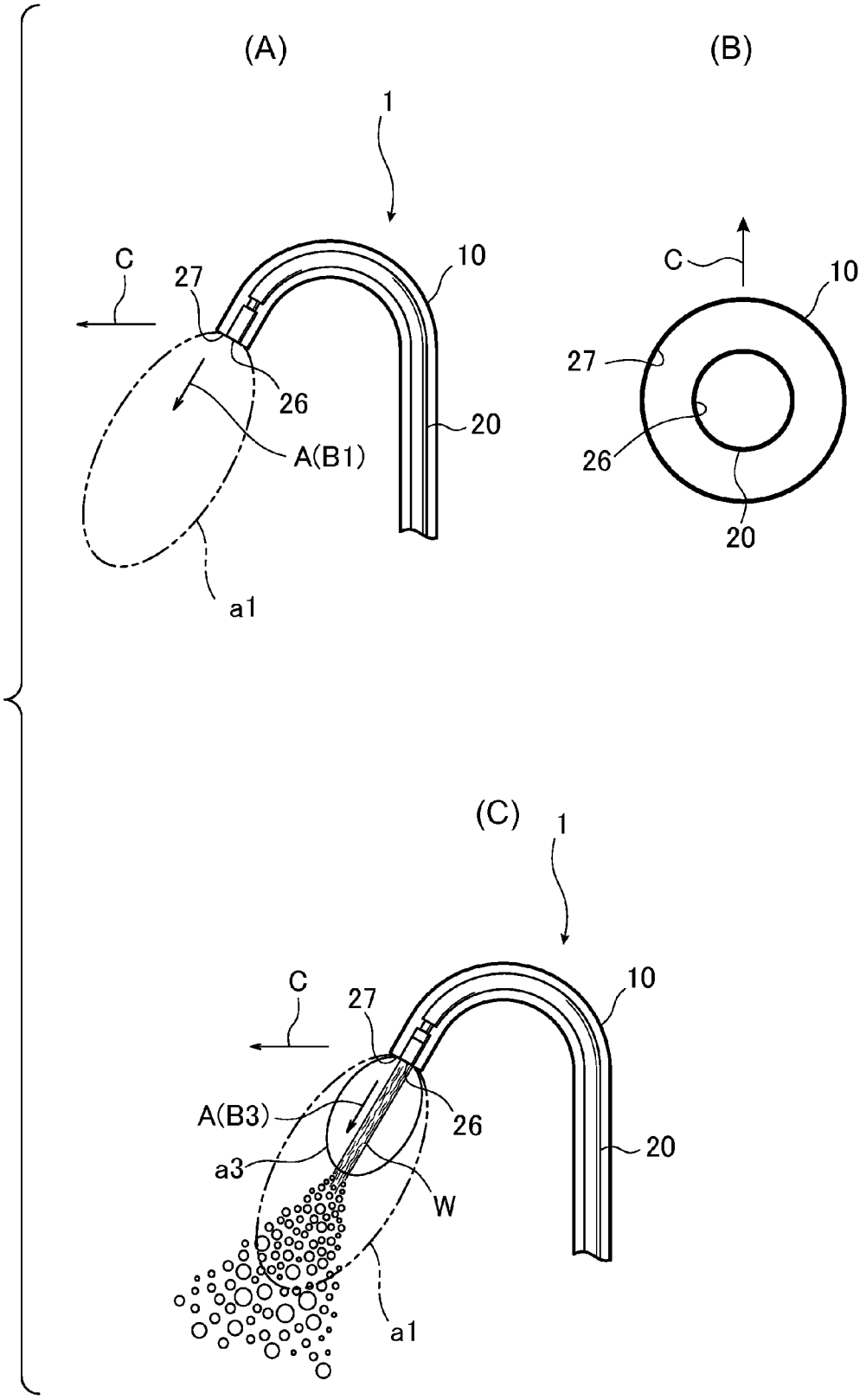
FIG. 21 is an explanatory diagram of a sensing range in an automatic faucet according to a modified embodiment of the present invention.

FIG. 21(C) illustrates a sensing range a3 during a water spouting state. The water pipe 20 is located in the central region of the radio wave emitting port 27, so that washing water W passes through an axis of the sensing range a1, and a radio wave emitted from the radio wave emitting port 27 interferes with the washing water W approximately evenly in a circumferential direction of the washing water W. Thus, an emitting direction B3 of the sensing range a3 approximately conforms to a spouting direction A without any deviation from the spouting direction A. During the water spouting state, the washing water stream W passes through a propagation path of a radio wave emitted from the radio wave emitting port 27, and therefore the radio wave is attenuated through the passing. Further, when the radio wave emitted from the radio wave emitting port 27 intrudes into the washing water stream W, it is attenuated through the intrusion. As above, in the embodiment illustrated in FIG. 21, the radio wave is attenuated by interference between the radio wave and the washing water stream W. As a result, a length of the sensing range a3 along the spouting direction (emitting direction B3) is reduced, and a detectable distance is reduced with respect to the sensing range a1 during the water stopping state.

It is to be understood that the radio wave attenuating effect by washing water in FIG. 21 is also applied to the embodiment in FIG. 1.

The above embodiment of the present invention may be modified in the following manner.

In the above embodiment, the conduit pipe 10 is used as a waveguide. Alternatively, a dedicated waveguide may be used. In this case, an automatic faucet may be configured such that a radio wave is propagated between the radio wave sensor 40 and an outlet of the conduit pipe 10 through the guide wave. Further, in the case of using a dedicated waveguide, this waveguide may be installed inside or outside the conduit pipe 10.

In the above embodiment, the cross-section of each of the conduit pipe 10 and the water pipe 20 has a circular shape. Alternatively, it may have any other suitable shape, such as a circular shape or a rectangular shape.

In the outlet portion of the conduit pipe 10, the radio wave emitting port may be disposed clearly on only the user side with respect to a spout port. In this case, a lateral width of the radio wave emitting port may be set to be equal to or less than a lateral width of the spout port. For example, a cross-section of the conduit pipe 10 is divided into two semicircular regions, and the radio wave emitting port and the spout port may be arranged in the cross-sectionally semicircular regions, respectively. Alternatively, a small-diameter radio wave emitting port may be provided within the outlet portion of the conduit pipe 10 at a position on the user side.

This configuration makes it possible to, during the water spouting state, direct a radio wave beam approximately completely toward the user side by interference (reflection) between the radio wave beam and a washing water stream. In this case, a sensing range does not exist below the spout port, so that it becomes possible to prevent a situation where the radio wave sensor 40 erroneously senses disorder of a flow of washing water occurring at a position away from the spout port when the washing water is spouted at a large flow rate, and reliably stop the water spouting after completion of hand washing.

Figure 22:
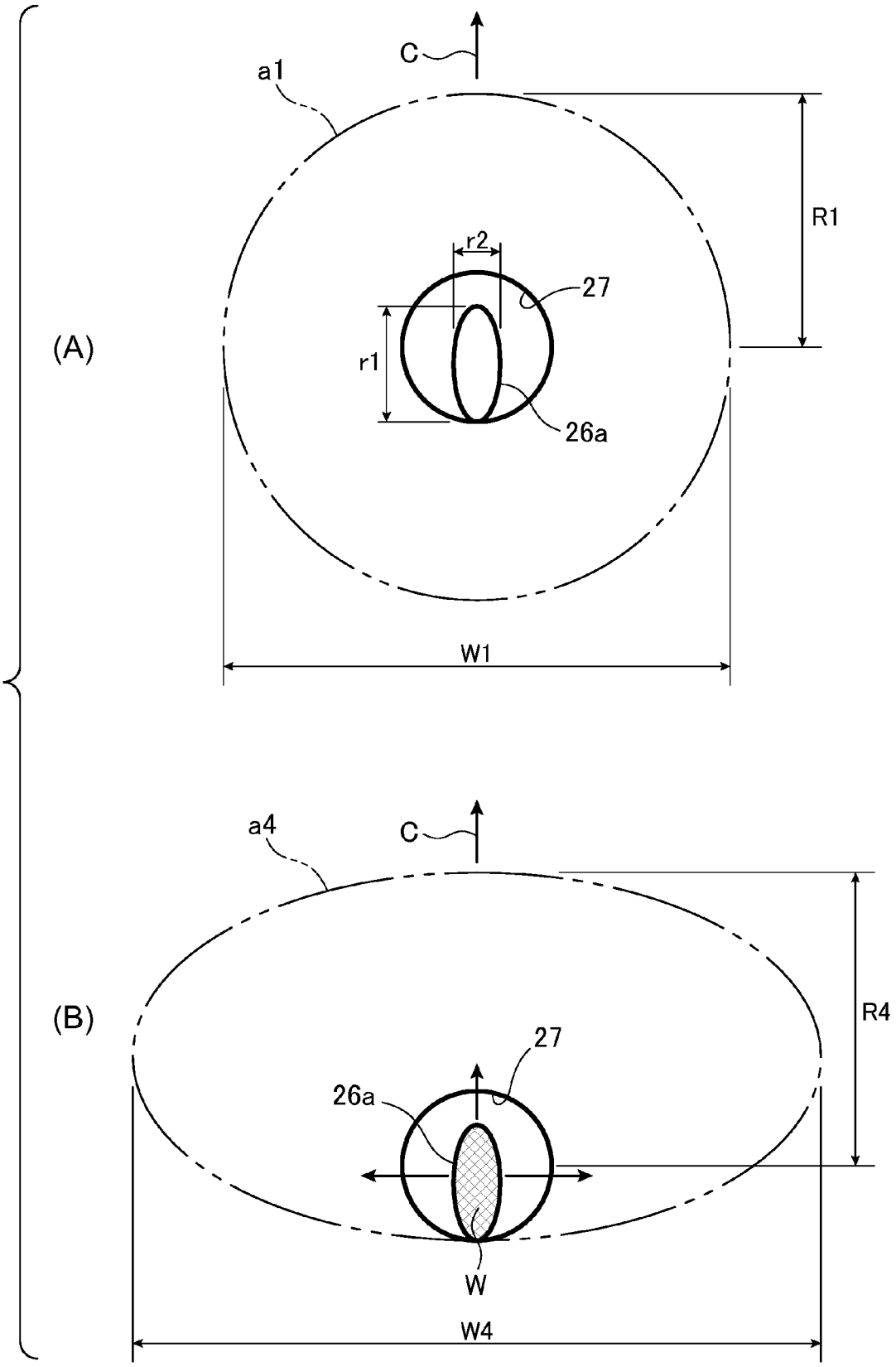
FIG. 22 is an explanatory diagram of a sensing range in the automatic faucet according to the modified embodiment.

In the above embodiment, the spout port 26 has a cross-sectionally circular shape. Alternatively, the cross-section of the spout port may be a vertically long shape as illustrated in FIG. 22. FIG. 22 illustrates a cross-section of a sensing range during the water stopping state, in a direction perpendicular to the spouting direction.

Differently from FIG. 18, in the example illustrated in FIG. 22, a spout port 26*a* has an oval shape in cross-section. This oval shape has a length r1 in a long axis direction, and a length r2 in a short axis direction (r1>r2). Further, the long axis direction of the oval shape is arranged along a direction from the base end of the faucet main unit 1A toward the user side. As with FIG. 18, the spout port 26*a* is disposed such that a region of an outer peripheral surface thereof on the side of the base end of the faucet main unit 1A comes into contact with or close to an inner peripheral surface of the conduit pipe 10.

Even if the spout port 26*a* has an oval shape, this change has almost no influence on a sensing range during the water stopping state. Thus, a sensing range during the water stopping state illustrated in FIG. 22(A) is substantially the same as the sensing range a1 in FIG. 18.

FIG. 22(B) illustrates a sensing range a4 during the water spouting state. During the water spouting state, as schematically indicated by the arrowed lines in FIG. 22(B), a radio wave emitted from the radio wave emitting port 27 is reflected by the washing water stream W. Thus, in the example illustrated in FIG. 22, a cross-section of the sensing range a4 is deformed into an oval shape in which a distance from a center of the radio wave emitting port 27 to a boundary thereof facing in a direction C toward the user side is R4, and a lateral width is W4. Preferably, the following relations are satisfied: R4>R1, and W4>W1.

In this case, the length r1 in the long axis is greater than the length r2 in the short axis, so that, in a peripheral surface of washing water spouted from the spout port, a lateral region of the peripheral surface orthogonal to the direction C toward the user side emits a larger amount of radio waves from the radio wave emitting port 27, as compared with a region of the peripheral surface facing the direction C toward the user side. Therefore, an amount of radio waves reflected in the lateral direction becomes larger than an amount of radio waves reflected in the direction C toward the user side. For this reason, as compared to FIG. 18, in the example illustrated in FIG. 22, the length R4 is less than the length R2 (R4<R2), and the width W4 is greater than the width W2 (W4>W2). Thus, in the example illustrated in FIG. 22, the spout port is changed in cross-sectional. Then, based on the spout port 26*a* and the radio wave emitting port 27, a relative ratio between a lateral length and a thicknesswise (direction orthogonal to the emitting direction and the lateral direction) length of the sensing range is changed to adjust a level of flatness of a sensing range during the water spouting state. Further, each of the lengths r1, r2 of the spout port 26*a* may be independently changed to adjust a respective one of absolute lateral and thicknesswise lengths of the sensing range. As above, the directivity setting means (double pipe structure) in this embodiment functions as means to adjusting a lateral shape and a thicknesswise shape of the sensing range.

In the above embodiment, in the spout region, the water pipe 20 is in contact with the lowermost region of the inner peripheral surface of the conduit pipe 10 (i.e., a region of the inner peripheral surface offset in a direction opposite to the direction C toward the user side). Alternatively, the water pipe 20 may be in contact with an uppermost region of the inner peripheral surface of the conduit pipe 10 (i.e., a region of the inner peripheral surface offset in the direction C toward the user side).

EXPLANATION OF CODES

1: automatic faucet 1
2: sink
3: washstand base
10: conduit pipe
11: inner peripheral surface
12: fixing member
20: water pipe
26: spout port
27: radio wave emitting port
28: reflecting member
40: radio wave sensor
50: control section
A: spouting direction
B1, B2: emitting direction
a1, a2: sensing range

What is claimed is:

1. An automatic faucet comprising a faucet main unit which includes a conduit pipe having a base end fixed to a support body and extending toward a user side, and a spout valve; and a water pipe disposed inside the conduit pipe and adapted to supply washing water to a spout port formed in a spout region as a distal end portion of the faucet main unit, the automatic faucet, comprising:

a radio wave sensor provided in the faucet main unit at a position on the side of the base end, and operable to output a detection signal for sensing a user's behavior state, by receiving a reflected wave of a radio wave transmitted;

a radio wave propagation space defined between an inner peripheral surface of the conduit pipe and an outer peripheral surface of the water pipe so as to allow a radio wave to be propagated therethrough, a radio wave emitting port formed in the spout region so as to emit a radio wave propagated through the radio wave propagation space, to the outside therethrough;

directivity setting means for setting directivity of a radio wave to be emitted from the radio wave emitting port; and control means operable, based on the detection signal from the radio wave sensor, to switch between open and closed states of the spout valve to thereby start and stop spouting of the washing water from the spout port, the control means being configured to determine a sensing range of the radio wave sensor, based on the detection signal having a signal value equal to or more than a predetermined value, wherein the directivity setting means is configured to allow a radio wave to be emitted from the radio wave emitting port along a water spouting direction of the washing water to be spouted from the spout port, as well as to allow a radio wave to be emitted such that at least a portion of a radio wave emitted from the radio wave emitting port partially interferes with a side at a user side of the washing water spouted from the spout port, wherein the directivity setting means is configured to set directivity of a radio wave such that at least a portion of a radio wave emitted from the radio wave emitting port is attenuated by an interference with the washing water to be spouted from the spout port, and then, by the attenuation of the radio wave, the sensing range during the water spouting state becomes shorter towards the spout region than the sensing range during the water stopping state, while by the attenuation of the radio wave, the sensing range on the side opposite to the user's side with respect to the washing water spouted from the spout port is made smaller during the water spouting state than during the water stopping state, and wherein the directivity setting means is configured such that a radio wave to be emitted from the radio wave emitting port is more largely attenuated on the side opposite to the user's side than on the user's side in the direction perpendicular to the water spouting direction, during the water spouting state.

2. The automatic faucet according to claim 1, wherein the directivity setting means is configured such that a radio wave to be emitted from the radio wave emitting port is interfered with the washing water to be spouted from the spout region so as to attenuate the radio wave and make the sensing range shorter in the spouting direction during the water spouting state than during the water stopping state.

3. The automatic faucet according to claim 2, wherein the directivity setting means is configured such that the sensing range during the water spouting state is made smaller at a larger rate in the water spouting direction than in the direction perpendicular to the water spouting direction, with respect to the sensing range during the water stopping state.

4. The automatic faucet according to claim 3, wherein it is configured such that the washing water to be spouted from the spout port passes through the sensing range during the water stopping state.

5. The automatic faucet according to claim 3, wherein it is configured such that the washing water to be spouted from the spout port passes through a region offset towards the side opposite to the user side, among the sensing range during the water stopping state.

* * * * *